US007484325B2

(12) United States Patent
Benedict et al.

(10) Patent No.: US 7,484,325 B2
(45) Date of Patent: Feb. 3, 2009

(54) CURVED SIGN ASSEMBLY

(75) Inventors: Michael A Benedict, Grand Rapids, MI (US); Charles R. Tyke, Grand Rapids, MI (US)

(73) Assignee: System 2/90, Inc., Grand Rapids, MI (US)

( * ) Notice: Subject to any disclaimer, the term of this patent is extended or adjusted under 35 U.S.C. 154(b) by 316 days.

(21) Appl. No.: 11/112,348

(22) Filed: Apr. 22, 2005

(65) Prior Publication Data

US 2006/0086025 A1 Apr. 27, 2006

Related U.S. Application Data

(60) Provisional application No. 60/620,921, filed on Oct. 21, 2004.

(51) Int. Cl.
*G09F 15/00* (2006.01)

(52) U.S. Cl. ..... 40/606.12; 40/606.18; 40/611.08; 40/738

(58) Field of Classification Search ..... 40/606.12, 40/606.18, 611.08, 650, 738, 624
See application file for complete search history.

(56) References Cited

U.S. PATENT DOCUMENTS 1,742,378 A * 1/1930 Boese ..... 40/738
5,255,968 A * 10/1993 Craven ..... 312/234
5,471,794 A * 12/1995 Nishioka ..... 49/501
6,279,822 B1 * 8/2001 Bertram ..... 40/606.05
6,530,167 B1 * 3/2003 Schuetz et al. ..... 40/611.08
6,594,934 B1 * 7/2003 Wong ..... 40/743
2005/0235537 A1 * 10/2005 Lee et al. ..... 40/607.03

* cited by examiner

*Primary Examiner*—Paul N Dickson
*Assistant Examiner*—Christopher E Veraa
(74) *Attorney, Agent, or Firm*—Flynn, Theil, Boutell & Tanis, P.C.; John A. Waters

(57) ABSTRACT

A curved sign assembly includes a flexible sign panel removably mounted in an arcuate position in a modular frame. The frame comprises a pair of edge rails mounted on opposite side edges of an intermediate member. The edge rails can clip on a variety of intermediate members of different sizes. The edge rails include inwardly facing open-sided channels that receive and hold side edges of the flexible sign panels on one or both sides of the intermediate members. Upper and lower plates cover the top and bottom sides of the sign. Horizontal or vertical reinforcing members positioned on the intermediate member for larger signs support the sign panels between the edges. The edge rails can be decorative extruded aluminum members that are attached in different lengths to a variety of intermediate members. A channel member can be mounted between the edge rails to receive the ends of sign panels that extend only part of the way between the edge rails and the side of the intermediate member.

9 Claims, 21 Drawing Sheets

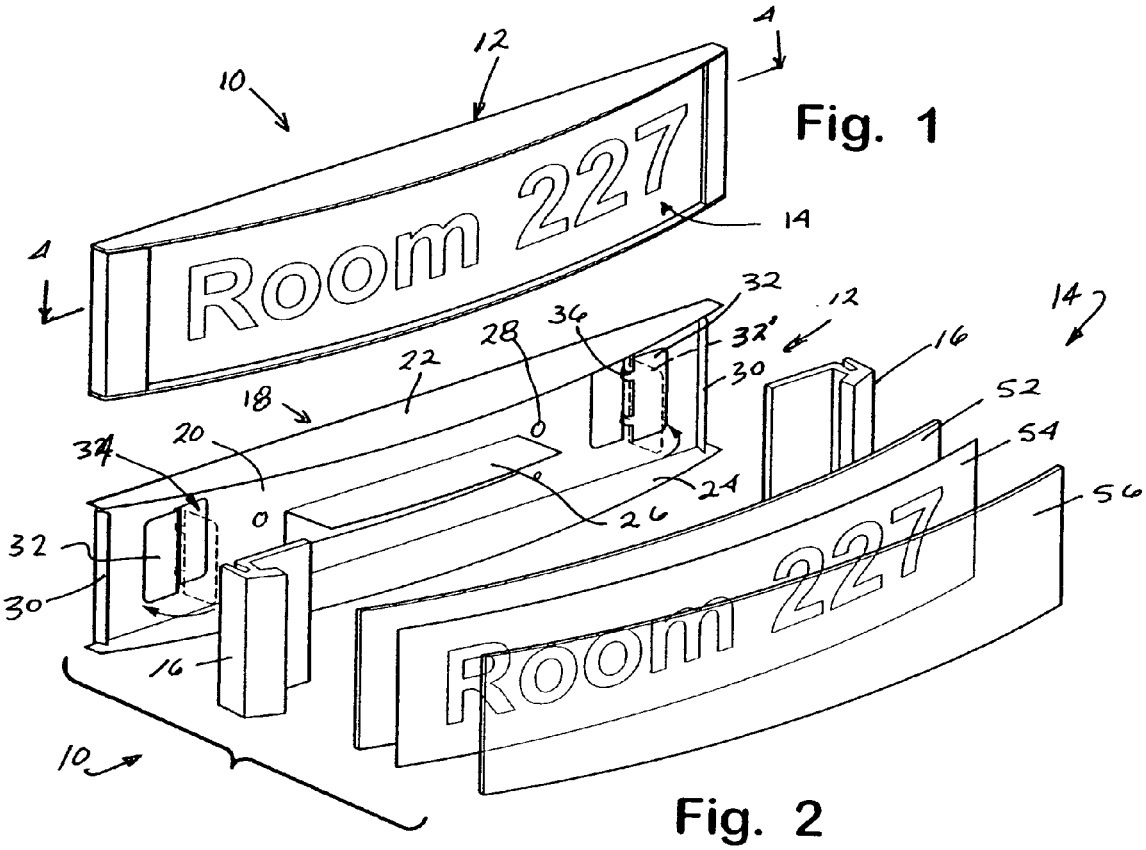
Fig. 1
Fig. 2
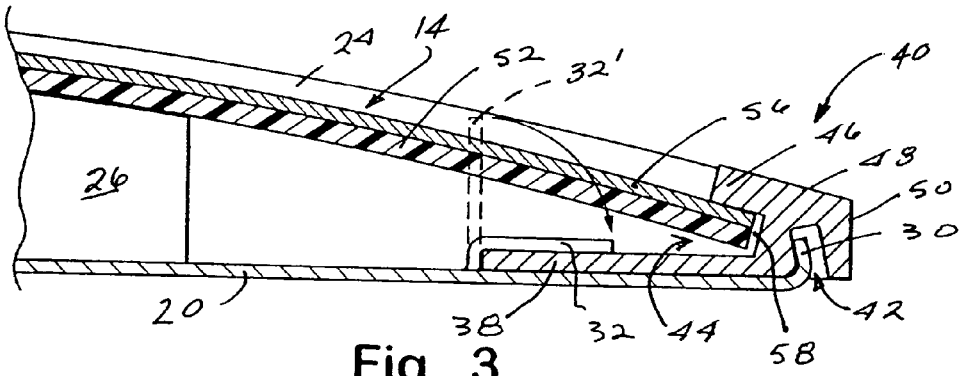
Fig. 3
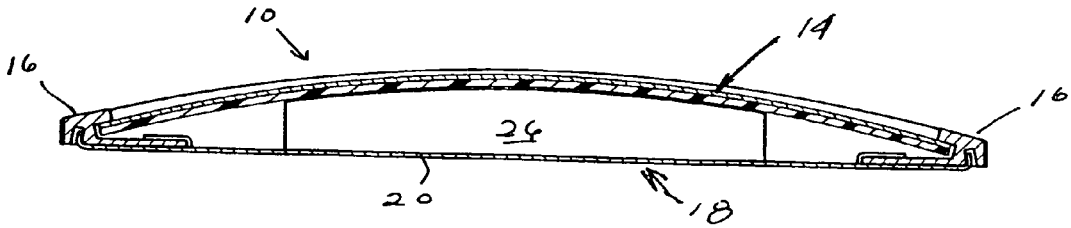
Fig. 4

CURVED SIGN ASSEMBLY

CROSS-REFERENCE TO RELATED APPLICATIONS

This in a non-provisional utility patent application continuing from and claiming the benefit of co-pending U.S. Provisional Patent Application No. 60/620,921, filed Oct. 21, 2004, which is incorporated here by reference.

BACKGROUND OF THE INVENTION

The present invention relates to a modular sign assembly of various modular configurations, wherein a flexible sign panel or insert is removably installed in a sign frame with the flexible sign panel defining a curved or arcuate panel member when in an installed position.

Sign systems employing removable sign panels typically comprise a sign panel or insert removably mounted in a frame or base. The sign may be of various sizes, from a small name sign that sits on a desk to a larger sign that is mounted to a wall or supported on a pedestal. Sign systems commonly vary in size from signs as small as about 2"×6" or smaller to signs that are about 48"×96" or larger. Signs may be single sided or double sided with the sign display panel revealed on one or both sides of the sign frame, respectively. Typically, a larger number of components are necessary to produce a wide variety of signs of different sizes and shapes. Multiple components are expensive and complicated.

BRIEF SUMMARY OF THE INVENTION

Accordingly, a curved sign assembly of the present invention provides a simplified modular sign system with a minimum number of components used for a wide variety of arcuate or curved sign assemblies. Thus, sign construction is simplified and sign tooling and inventory resources are minimized. More specifically, the modular assembly system according to the invention includes a frame, opposing first and second end plates, first and second channel members or edge rails, an optional intermediate support, and a sign panel. The frame has opposing first and second frame edges, opposing third and fourth frame edges, and opposing first and second frame sides. The first frame side faces a first direction and the second frame side facing an opposing second direction. The opposing first and second end plates extend toward the first direction from the opposing first and second frame edges, respectively. The first end plate extends to a first plate terminal edge, and the second end plate extends toward a second plate terminal edge. The first and second edge rails extend along the third and fourth frame edges, respectively, and between the opposing first and second frame edges. The first channel member defines a first open-sided channel with the open side on the first frame side and facing the fourth frame edge, while the second channel member defines a second open-sided channel with the open side on the first frame side and facing the third frame edge. The intermediate support may have a length that extends between one of the pair of the opposing first and second frame edges and the pair of the opposing third and fourth frame edges. The intermediate support also extends in the first direction and generally perpendicularly to its length from a base edge to a terminal support edge. The sign panel has opposing sign edges with one of the sign edges releasably seated in the first open-sided channel and with the other of the sign edges releasably seated in the second open-sided channel. Thus, the sign panel extends from the first open-sided channel and across the intermediate support to the second open-sided channel, whereby the sign panel is curved between the first and the second open-sided channels.

In one aspect of the invention, at least one of the first and the second plate terminal edges is curved and corresponds to an arc of the curved sign panel. In another aspect, at least one of the pair of the first and the second plates and the pair of the first and the second channel members is parallel. And, in a further aspect, at least one of the first and second channel members is a separate component that is releasably coupled with the corresponding one of the third and the fourth frame edges, whereby the curved sign assembly is reconfigurable.

In other aspects of the invention, the intermediate support is oriented either with the support length extending between the first and the second open-sided channels with the support terminal edge being curved and corresponding to an arc of the curved sign panel or with the support length extending between the opposing first and second frame edges. Further, the intermediate support may be oriented with the support length extending between the opposing first and second frame edges, the support terminal edge may define a third open-sided channel with the open side opening toward one of the first and the second open-sided channels, and at least a portion of the sign panel may extend from the one of the first and the second open-sided channels to the third open-sided channel. Further yet, when the intermediate support is oriented with the support length extending between the opposing first and second frame edges, the support terminal edge may define opposing third and fourth open-sided channels with the open sides of the third and the fourth open-sided channels opening toward the first and the second open-sided channels, respectively and the sign panel may include at least first and second sign panel portions with the first sign panel portion extending between and releasably engaging each of the first and the third open-sided channels, while the second sign panel portion extending between and releasably engaging each of the second and the fourth open-sided channels. And, still further, the intermediate support may be one of at least two intermediate supports.

In further aspects of the invention, at least one of the first and second channel members is a separate component that is coupled with the corresponding one of the third and the fourth frame edges, and the corresponding one of the third and the fourth frame edges has a manually actuatable clamp that securely clamps the one of the first and second channel members with the corresponding one of the third and the fourth frame edges. Further the corresponding one of the third and the fourth frame edges has a flange and the one of the first and second channel members has a cooperating flange groove in which the flange is received in slip fit engagement.

In one more aspect of the invention, the modular assembly system according to the invention may include a double sided curved sign assembly that further has third and fourth plates, third and fourth open-sided channels extending along the opposing third and fourth frame edges and between the opposing first and second side edges, respectively, a second intermediate support, and a second sign panel. The third and fourth plates extend toward the second direction from the opposing first and second frame edges, respectively, to third and fourth plate terminal edges, respectively. The third and fourth open-sided channels have open sides that open on the second frame side and face the opposing fourth and third frame edges, respectively. The second intermediate support has a second support length, has a second support base edge extending along the second support length, and has an opposing second support terminal edge extending along the second support length. The second support length extends between one of the pair of the opposing first and second frame edges and the pair of the opposing third and fourth frame edges. The second intermediate support also extends in the second direction from the second support base edge to the second support terminal edge. The second sign panel has opposing first and second sign edges and has opposing second sign back and second sign display surfaces that extend between the first and second sign edges. One of the opposing second sign edges being seated in the third open-sided channel in releasable engagement, the second sign panel extending from the third open-sided channel and across the second intermediate support to the fourth open-sided channel, and the other of the opposing second sign edges being seated in the fourth open-sided channel in releasable engagement, whereby the second sign panel is curved between the third and the fourth open-sided channels.

BRIEF DESCRIPTION OF THE SEVERAL VIEWS OF THE DRAWING

The invention will now be described with reference to the drawings, in which:

FIG. 1 is a perspective view of a first embodiment of a sign constructed in accordance with the present invention.

FIG. 2 is an exploded view of the sign of FIG. 1.

FIG. 3 is an enlarged fragmentary cross-sectional view of an end of the sign shown in FIG. 4.

FIG. 4 is a cross-sectional view taken along lines 4-4 of FIG. 1.

FIG. 23 is a perspective view of an eighth embodiment of a sign constructed in accordance with the present invention, showing a two-sided sign adapted to be mounted on a wall or ceiling surface and extend perpendicularly there from.

FIG. 26 is a perspective view of a ninth embodiment of a sign constructed in accordance with the present invention, showing a large two-sided sign installation adapted to be mounted on a surface and to extend perpendicularly there from.

DETAILED DESCRIPTION OF PREFERRED EMBODIMENT

Figure 5:
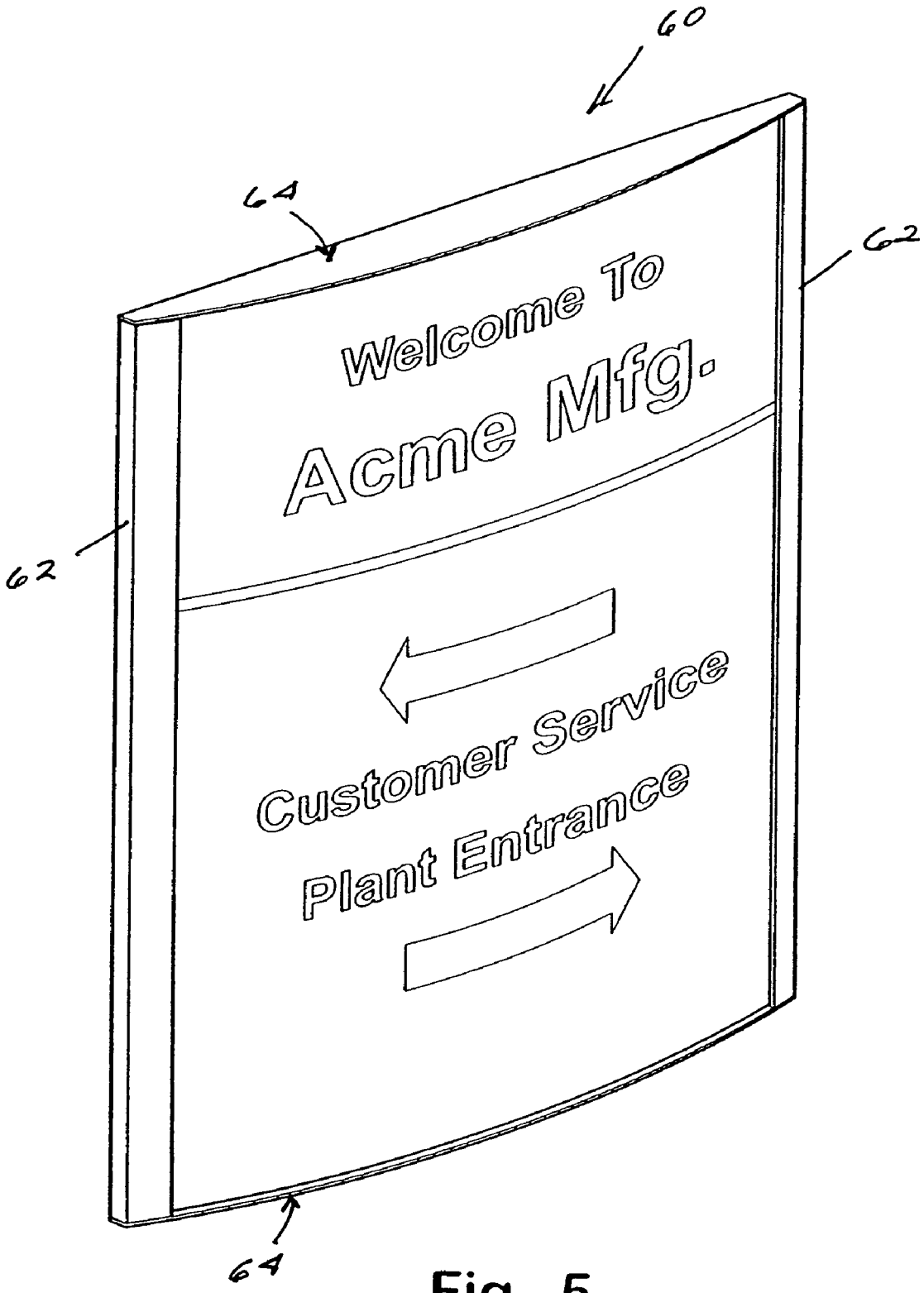
FIG. 5 is a perspective view of a second alternative embodiment of a sign constructed in accordance with the present invention, showing a larger, wall sign.

As used herein, unless otherwise indicated, terms indicating the positions of the various components are intended to indicate relative positions of the components with respect to one another and not a fixed position or direction. The term "fowardly" indicates that direction in which the signage is facing. The "side" of a sign is the edge of the sign that extends parallel with the curvature axis of the sign. The "top" and "bottom" or "upper" and "lower" sides of the sign are the sides that are perpendicular to the axis of curvature of the sign. The "back" or "rear side" of a sign is the side or direction opposite to the forward facing side of the sign. "Inwardly" and "outwardly" indicates a direction toward the interior of the frame or a direction away from the interior of the frame.

Referring to the drawings, a first embodiment 10 of a sign assembly is shown in FIGS. 1-4. Sign assembly 10 includes a sign holder or frame 12 and a removable sign panel or signage inserts 14. The frame 12 includes a pair of spaced edge rails or end caps 16 that engage and hold opposite side edges of the signage inserts 14, and an intermediate member or sub-frame 18 that engages and holds the end caps or channel members 16 in place. In the embodiment of FIG. 1, the intermediate member 18 comprises a stamped sheet metal casing, desirably formed of 22 gauge steel and coated with a powder coating or other protective coating.

The sheet metal casing is further desirably stamped from a single sheet of metal and includes a back plate 20, arcuate upper and lower plates 22 and 24, respectively, that extend forwardly from opposing upper and lower edges of the backplate, and an intermediate arcuate plate or support 26 that extends forwardly from the back plate at a position intermediate the upper and the lower plates 22 and 24. The arcuate plate 26 provides rearward support of the signage inserts in the sign holder. Fastener openings 28 may be provided in back plate 20 to fasten the sign holder 12 to a wall or other support surface using threaded fasteners, for example.

Side edges of the backplate include forwardly and inwardly inclined flanges 30. Spaced inwardly from the flanges are foldable tabs 32, which are stamped from back plate 20, forming openings 34. Tabs 32 are attached to the backplate by spaced narrow legs 36 that make it relatively easy to fold the tabs from a forwardly extending position 32' (shown in phantom in FIGS. 2 & 3) to a folded or closed position 32 by folding the tabs outwardly.

End rails 16 fit in opposite ends of sign holder casing 18 and are manually clamped in place by means of tabs 32, as shown in FIG. 3, which serve as manually actuable clamps. End caps 16 include a base plate 38 that abuts backplate 20 of the casing and extends between flange 30 and tab 32. An enlarged rim 40 is formed on an outer edge of base plate 38 and extends forwardly therefrom. Rim 40 has an inwardly inclined flange groove 42 in a rear side that engages flange 30. Rim 40 has a sign retaining groove 44 facing forwardly from a front surface thereof, and relative to a front surface of the frame 12, and inclined inwardly toward the center of the sign, and toward the opposing frame edge. A flange 46 forms an outer side of the groove 44. Flange 46 has an inclined outer surface 48 that extends to an end surface 50 that is generally perpendicular to a flat back surface of the end cap and to a back surface of the frame 12. Preferably, rim 40 is formed as an aluminum extrusion. A long extrusion may be cut to any desired length for an end cap for either side of the sign and for any sign of any length. The exterior surfaces 48 and 50 on the end cap may be provided with a brushed aluminum appearance so as to present a pleasing appearance.

Sign inserts 14 are formed of flexible sheet material that is sized and shaped so that the insert will fit inside the casing 18, with opposing side edges of the insert fitting under opposing flanges 46 and extending substantially toward the bottom of groove 44. The inserts should be long enough in a sideways direction that if the sign is slid in a sideways direction an end of the sign will not become disengaged from the flange 46 of the edge cap 16 in which it is retained. On the other hand, the inserts should also be flexible enough that they may be flexibly deformed inwardly sufficiently that the side edges of the inserts may be slipped out of contact with the end caps. In a preferred embodiment of the invention shown in FIG. 3, there is a space 58 between a side edge of the sign insert and a bottom of groove 44. This provides tolerances for manufacturing variation, while still making sure that the edges of the sign remain under flanges 46 unless the sign is intentionally removed from the sign holder. In the preferred embodiment of the present invention space 58 is approximately ⅛ inch (3 mm) wide.

The signage insert panel 14 has opposing back and display surfaces and may be formed in a number of ways. The sign insert may be a single panel insert having signage printed or embossed on the outer display surface thereof. This signage insert may include a covered, provided by a transparent thin plastic lens material that protects the signage, if desired. Further, the insert panel may include signage printed on a ordinary piece of paper that is sandwiched between a flexible backer and a transparent lens. Signs according to the invention may be constructed so that the signage inserts may be printed on paper of conventional sizes, such as about 8½ by 11 inches (216×279 mm), 8½ by 14 (216×356 mm), or 11 by 17 inches (279×432 mm).

Referring to FIG. 2, signage insert panel 14 includes a back plate or backer 52, a printed sign 54, and a transparent lens 56, all of which are substantially the same size. Backer 52 desirably is formed of a relatively stiff but flexible plastic resin. Sheet material formed of ABS plastic about 0.060 inches (1.52 mm) thick is desirable. The lens material may be formed of clear PETG plastic about 0.40 inches (10.2 mm) thick. Velvet surface on the lens material is desirable for nonglare purposes. Ordinary paper may be used for printing sign 54. The three elements of the sign are clearly shown in FIG. 2, but the thin paper sign is not visible in FIGS. 3 or 4. A sign may optionally be printed on the backer in FIG. 3, a paper sign 54 may alternatively be inserted between the lens and backer. Sign 54 may be formed with any thin material that is capable of displaying signage information. An advantage of a separate sign insert 54 is that the signage may be replaced easily without modifying the sign construction itself.

The sign of FIGS. 1-4 is designed to be provided in a series of sizes in the preferred embodiment. While the height of the sign may be as small as one inch (25.4 mm), sign height is typically a minimum of about two inches (51 mm) or higher. The signs may be constructed in a variety of widths, such as 4 inches (102 mm), 6 inches (152 mm), 8½ inches (216 mm), 14 inches (356 mm) and 17 inches (432 mm). These correspond with conventional paper sizes for easy sign preparation.

Figure 6:
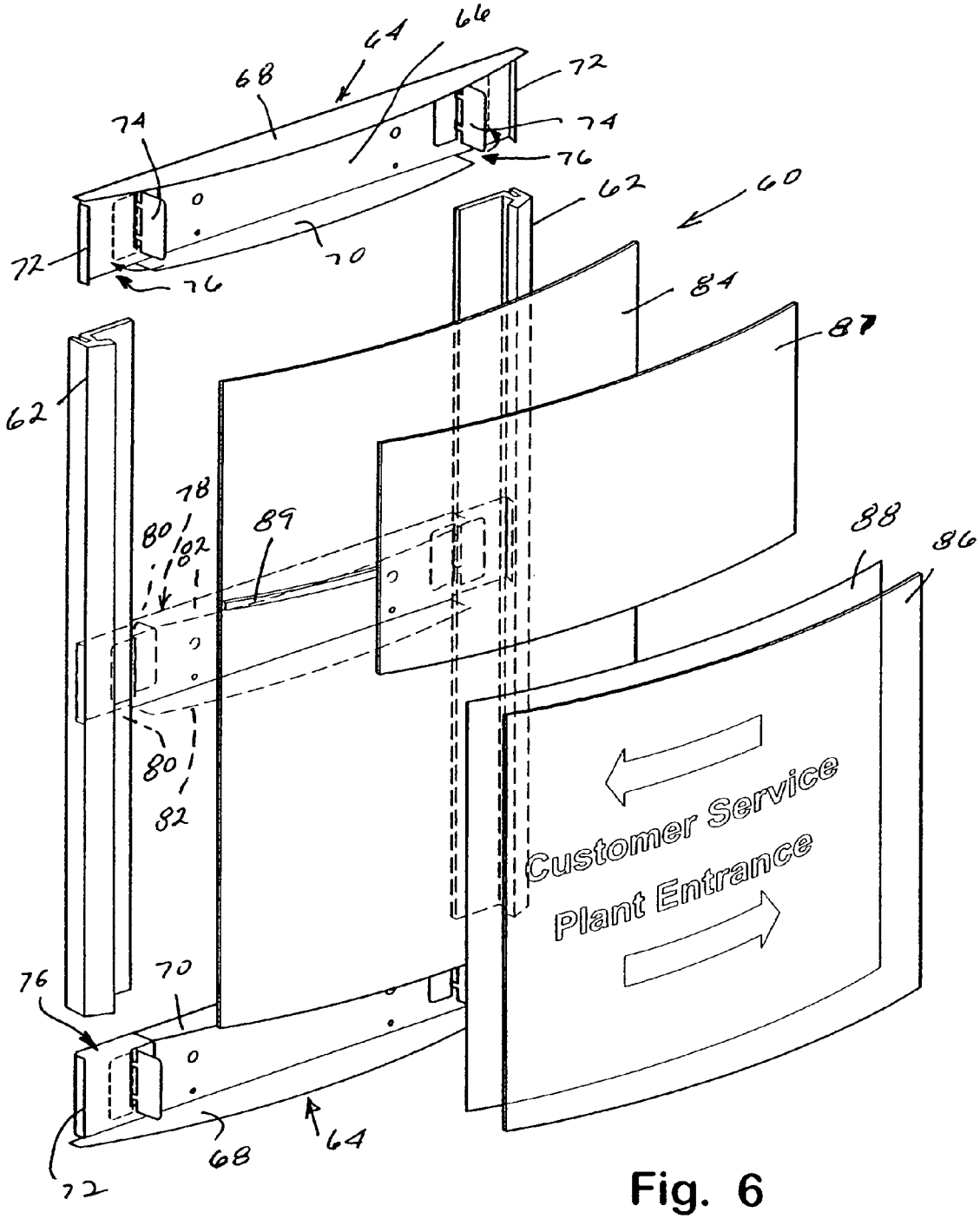
FIG. 6 an exploded view of the wall sign of FIG. 5.

A second embodiment 60 of the present invention is shown in FIGS. 5 and 6. Embodiment 60 is designed to be used for signs that are somewhat larger than the signs of FIG. 1. Sign assembly 60 includes end caps or edge rails 62 constructed of the same extrusions as end caps 16 of embodiment 1. These end rails or channel members 62 are somewhat longer than the end rails 16 of FIG. 1. Rather than have a single casing that covers the entire back of the sign, separate intermediate members 64 may be mounted at upper and lower ends of the end rails in the same manner as casing 18 of FIG. 1. Intermediate members 64 are stamped sheet metal components that are similar in shape to casing 18 of FIG. 1 and include a back plate 66, upper plate 68 having a curved forward edge, a lower plate 70 also having a curved forward edge, inwardly inclined flanges 72 at the side edges of the back plate and foldable tabs 74. Intermediate members 64 may not include an intermediate support flange similar to flange 26 of FIG. 2. Also, the plate 70 is recessed or notched to provide an open space 76 adjacent the opposing side edges of the member, so that the intermediate member can fit over the ends of end rails 62.

The intermediate member 64 on the lower end of sign 60 is identical to the intermediate member on the upper end, except that the member is upside down, with lower plate 70 being on the upper side and upper plate 68 being on the lower side. Plates 68 are sufficiently large to cover the opposing edges or ends of the sign.

A sign constructed in this manner desirably has a width of 6 inches (152 mm), 8½ inches (216 mm), 11 inches (279 mm), 14 inches (356 mm) or 17 inches (432 mm) and may be of any height. An internal support member 78 desirably is employed if the height of the sign is 11 inches (279 mm) or more. Additional support members 78 are preferably used with further 11 inch (279 mm) increments of sign height. Thus, a sign according to the invention may be of any height, with addition of internal supports as noted.

Internal support 78 is substantially the same as intermediate members 64, with the exception that the recesses 80, corresponding to recesses 76 in members 64 are formed in both the upper and lower plates 82, so that internal member 78 may be positioned at an intermediate position between the intermediate members 64 at the opposing sign edges, as shown in FIG. 6. Dimensionally, in a preferred practice of the invention, the intermediate members 64 are about 1 and ½ inches high (38 mm).

Sign 60 may include a backer 84 of substantially the same material as backer 52. Because of the increased height of the sign, separate signage elements may be used. In the illustrated embodiment, a lower lens 86 covers the lower sign 88, while an upper sign element 87 is positioned above lower signage elements 86 and 88. An accent strip 89 slightly thicker than signage elements 86 and 88 and 87 may be taped on a front surface of backer 84 by double sided tape, for example. The accent strip provides a spacer between the upper and lower signage elements and may also provide proper registration of multiple sign elements.

Figure 7:
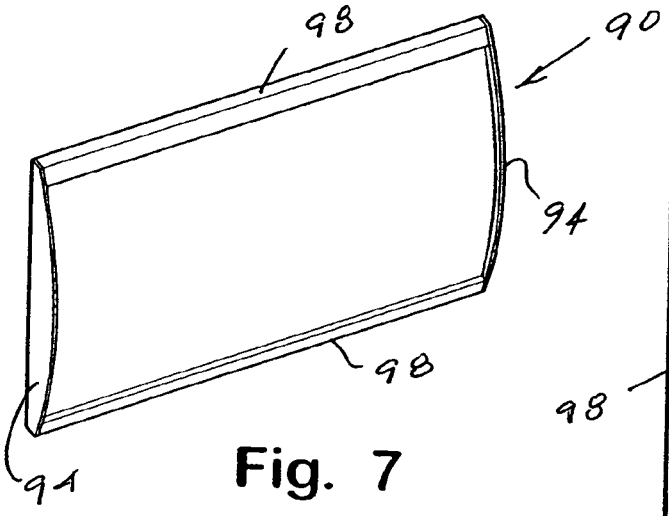
FIG. 7 is a perspective view of a third alternative embodiment of a sign constructed in accordance with the present invention, showing an assembled wall sign oriented with an axis of curvature of the sign face in a horizontal plane.
Figure 8:
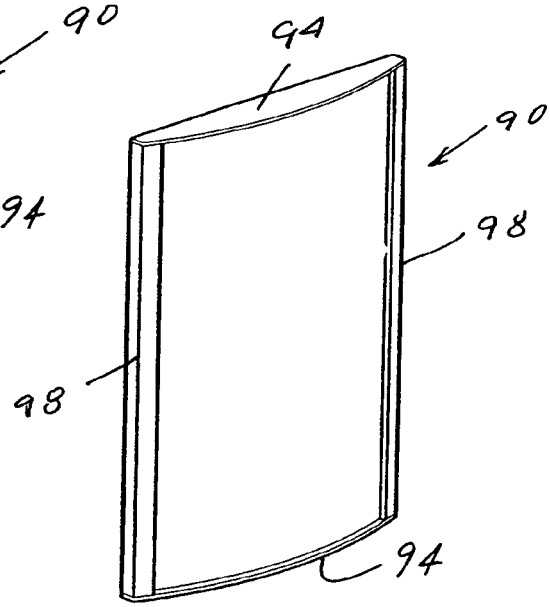
FIG. 8 is a perspective view of the sign of FIG. 7, oriented with the axis of curvature of the sign face in a vertical plane.
Figure 9:
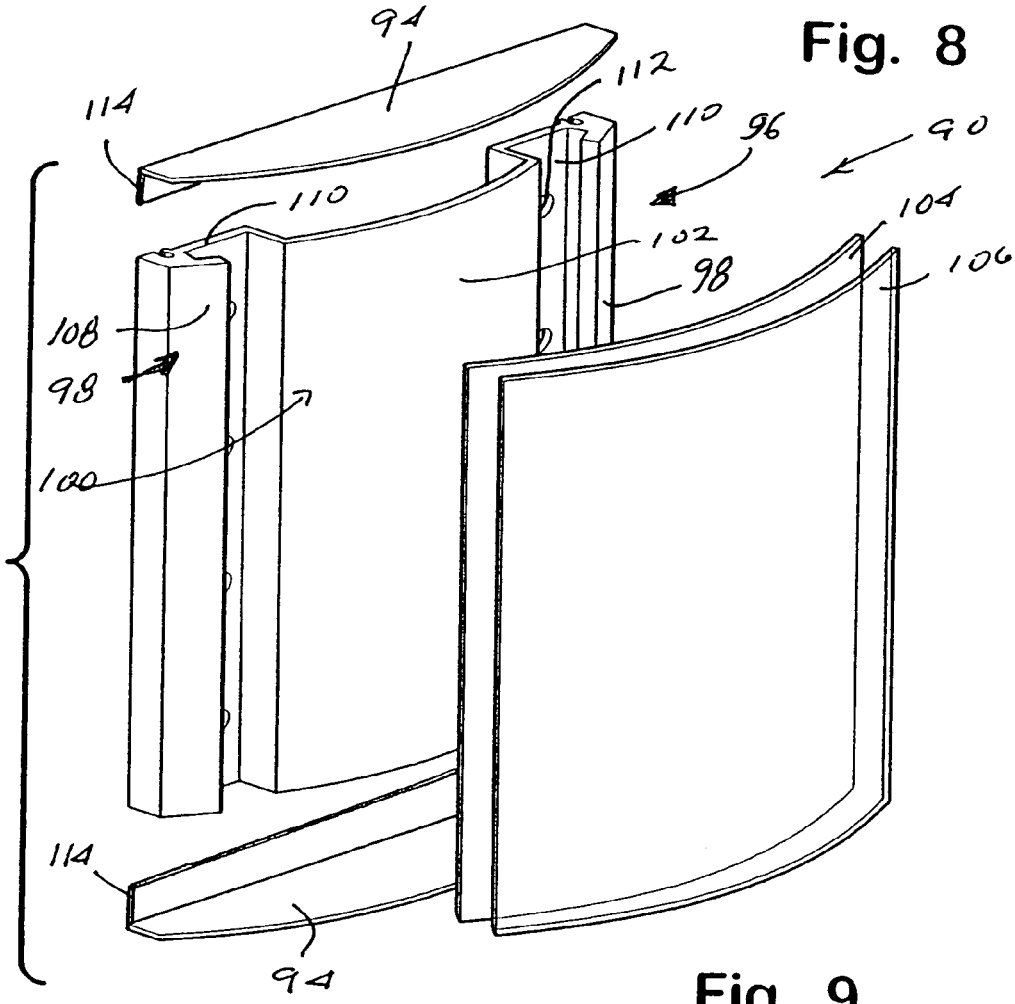
FIG. 9 is an exploded view of the sign of FIGS. 7 and 8.
Figure 10:
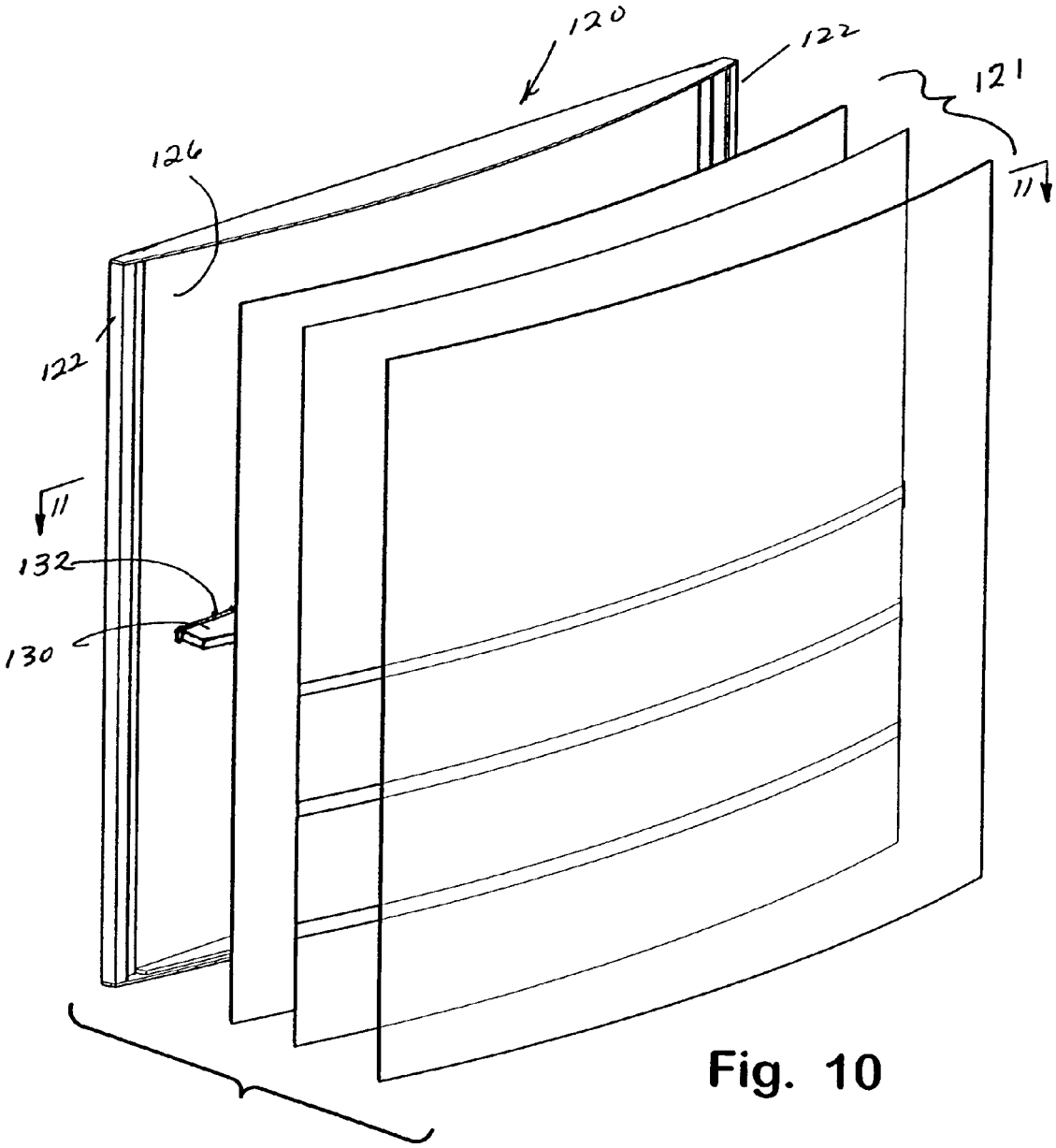
FIG. 10 is an exploded view of a fourth embodiment of a sign constructed in accordance with the present invention, showing a somewhat larger wall sign.
Figure 11:
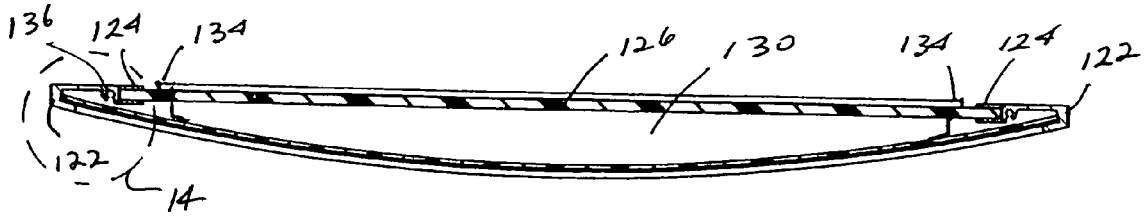
FIG. 11 is a cross-sectional view of the sign of FIG. 10 along line 11-11.
Figure 12:
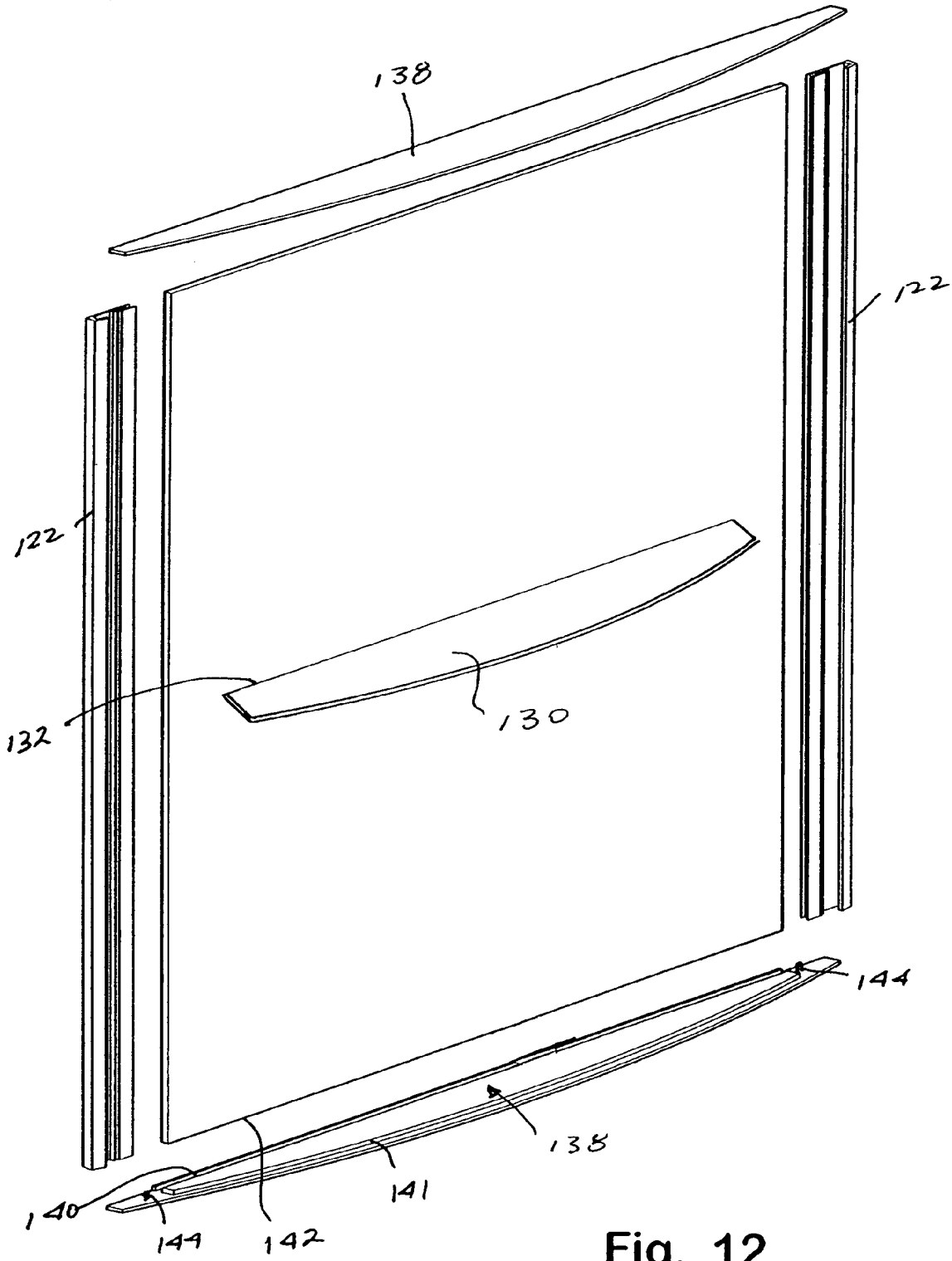
FIG. 12 is an exploded view of the sign frame of the sign of FIG. 10, with the sign insert and back plate removed.

A third embodiment 90 of the present invention is shown in FIGS. 7-9. This embodiment is designed for a relatively narrow sign, approximately four inches (102 mm) wide, of any height. Sign 90 comprises a frame comprising upper and lower cover plates 94 and an intermediate extruded metal back plate 96 that includes end rails or channel members 98 and an intermediate member 100. Intermediate member 100 has an arcuate forward surface 102 that serves as a backing for curved sign insert components 104 and 106. Sign elements 104 and 106 may be a backer and lens as described above, and a sign formed on paper or the like may be sandwiched between the elements. Alternatively, the signage may be applied directly to the sign insert elements.

Back plate 96 desirably is a metal extrusion that may be formed to any desired length. As in prior embodiments, the end rails 98 of the extrusion include inwardly inclined flanges 108 that grip the edges of sign inserts 104 and 106. A flat rib 110 extends inwardly from each end rail 98 to arcuate surface 102. Spaced holes 112 in the ribs are provided for fastening the sign to a flat wall surface.

Upper and lower cover plates 94 are formed of sheet material, desirably stamped metal, and have an L-shaped configuration, with a back lip 114 extending over the back upper and lower edges of intermediate member 100.

A fourth embodiment of the present invention 120 is shown in FIGS. 10-14. This embodiment is designed for wider signs 121, typically signs that are greater than 17 inches (432 mm) wide. With this sign, end rails 122 have swedge fittings 124 at inner edges thereof and a sheet of plastic resin 126 interconnects the end rails and serves as an intermediate member. Side edges of intermediate member 126 are resiliently engaged in swedge fittings 124 and are held in place by internal teeth that are inclined inwardly to permit insertion of the intermediate member but to resist withdrawal of the intermediate member from the swedge fitting. Desirably, the intermediate member is a sheet of relatively stiff plastic material, preferably ABS plastic. In the preferred practice of the present invention, the ABS plastic is about 0.175 inches (4.4 mm) thick, and the distance between the teeth in the swedge fitting is approximately 0.150 inches (3.8 mm), thus, the edge of the intermediate sheet is wedged tightly in the swedge fitting when the end rail is pressed over the edges of the sheet. The sheet, because of its inherent stiffness and thickness, provides somewhat flexible but generally self-supporting backing for the sign. With this construction, the width of the sign may be varied simply by using sheet material of different widths. The width of the sign may be virtually any width, with signs 48 inches (1219 mm) or wider being feasible.

The height of the sign may be as low as 2 inches (50 mm) and may be as high as almost any height and being limited only by the length of available extrusions as end rails or channel members. A 96 inch (2438 mm) high sign is feasible with existing 96 inches (2438 mm) end rail extrusions.

When the signs are more than about 6 inches (152 mm) high, an internal arcuate support member 130 may be employed. Support member 130 may be formed with the same material as member 126. To attach internal support member 130 to intermediate member 126, desirably, a slot 132 is formed in intermediate member 126. The support 130 may be inserted into the slot in a direction from a back surface of the intermediate member 126 to an opposing front or display facing surface. Outer edges of internal support member 130 fit closely through slot 132. Tabs 134 on the rear side or base edges of internal support member 130 engage the back surface of intermediate member 126 at the ends of the slot and prevent the internal support member from passing all the way through the slot. The internal support member is then solvent welded to the intermediate member desirably by a conventional solvent such as methyl ethyl ketone (MEK). MEK solvent eliminates the need for any mechanical fasteners. All that is required is that the solvent be applied and the parts be pressed fit together and the solvent will attach the components rigidly.

Figure 13:
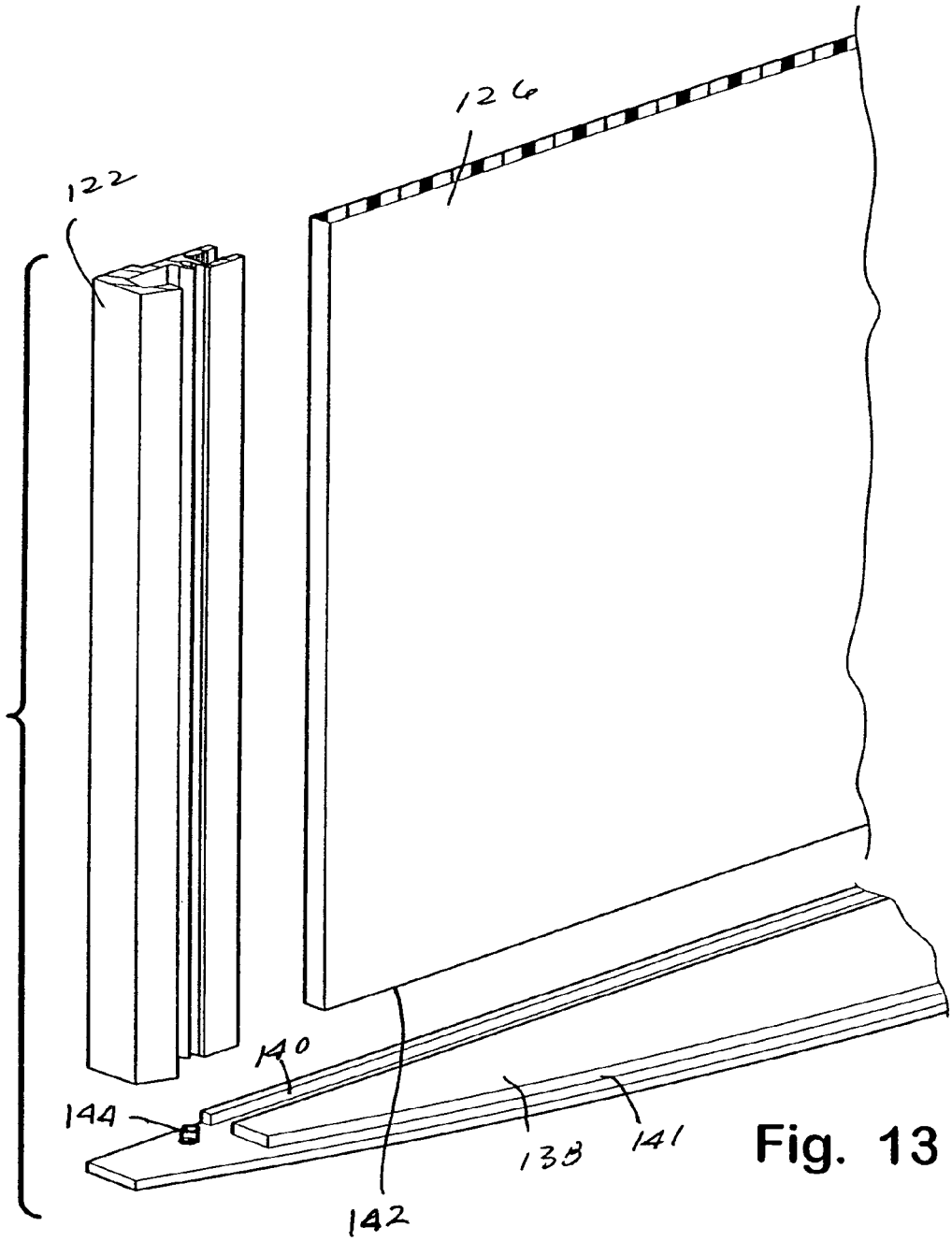
FIG. 13 is an enlarged fragmentary detail view of the lower left corner of the view of FIG. 12.
Figure 14:
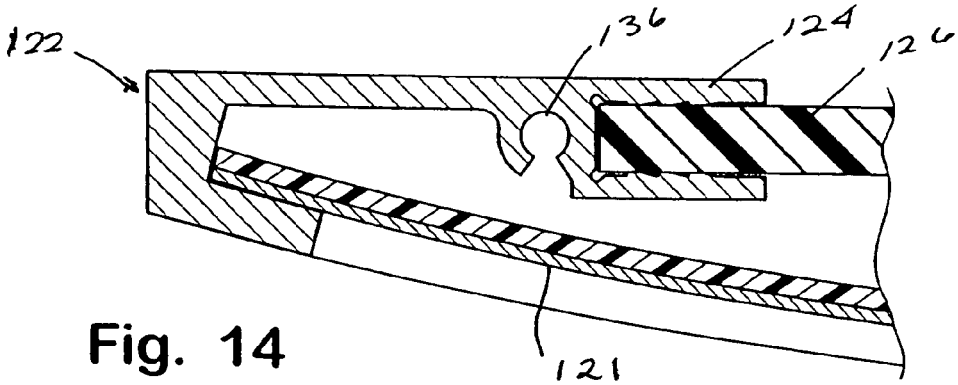
FIG. 14 is an enlarged fragmentary cross-sectional view of the detail 14 of FIG. 11.
Figure 15:
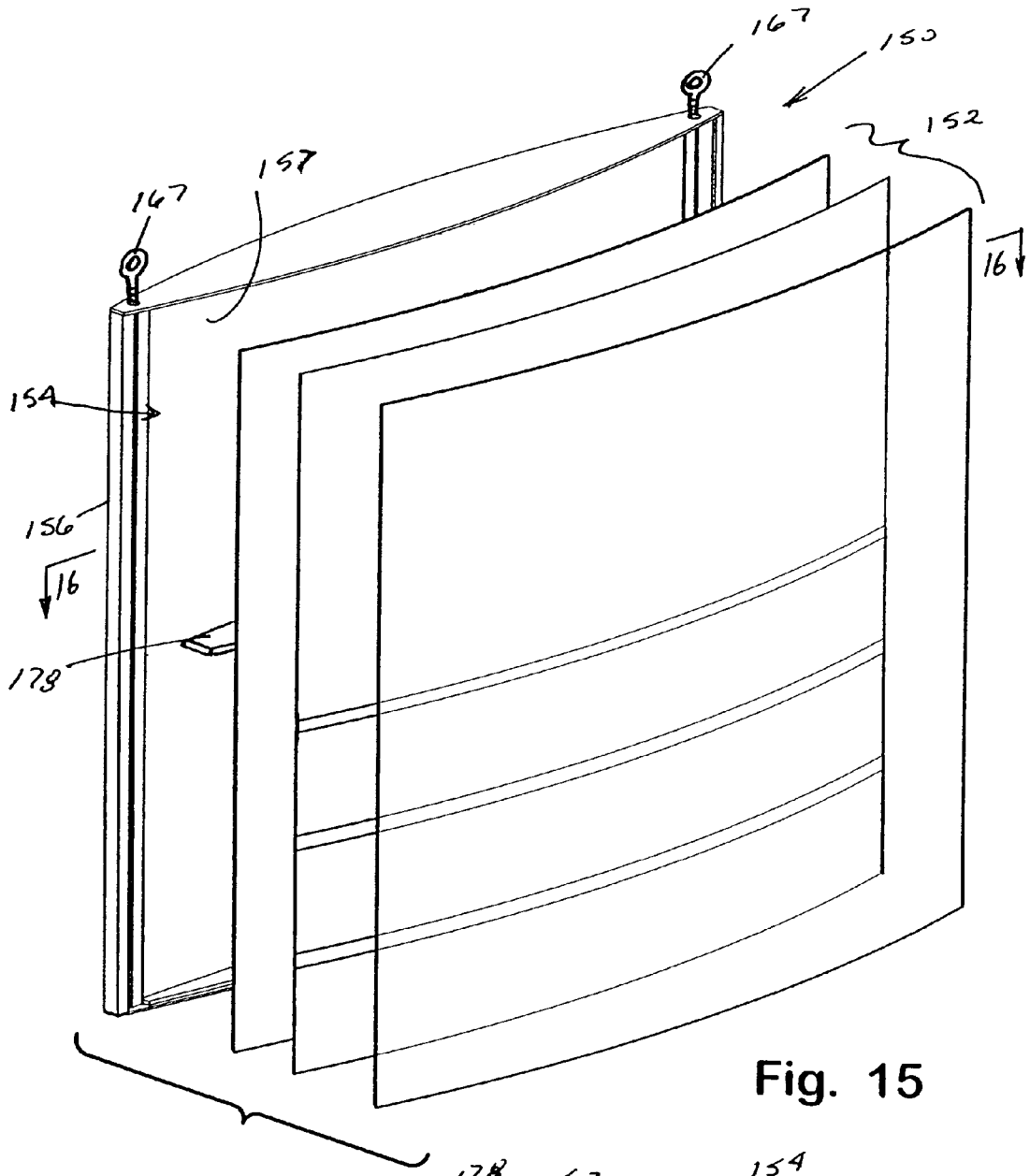
FIG. 15 is an exploded view of a fifth embodiment of a sign constructed in accordance with the present invention, showing a two-sided sign that that is fitted with hooks for hanging the sign.
Figure 16:
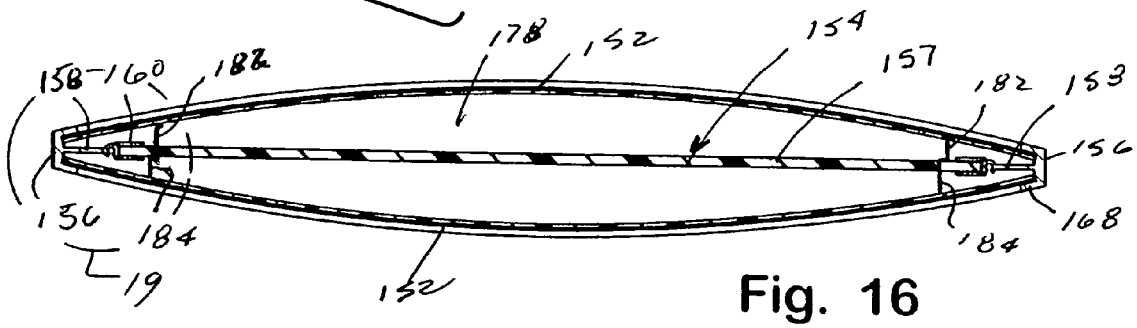
FIG. 16 is a cross-sectional view along line 16-16 thereof.
Figure 17:
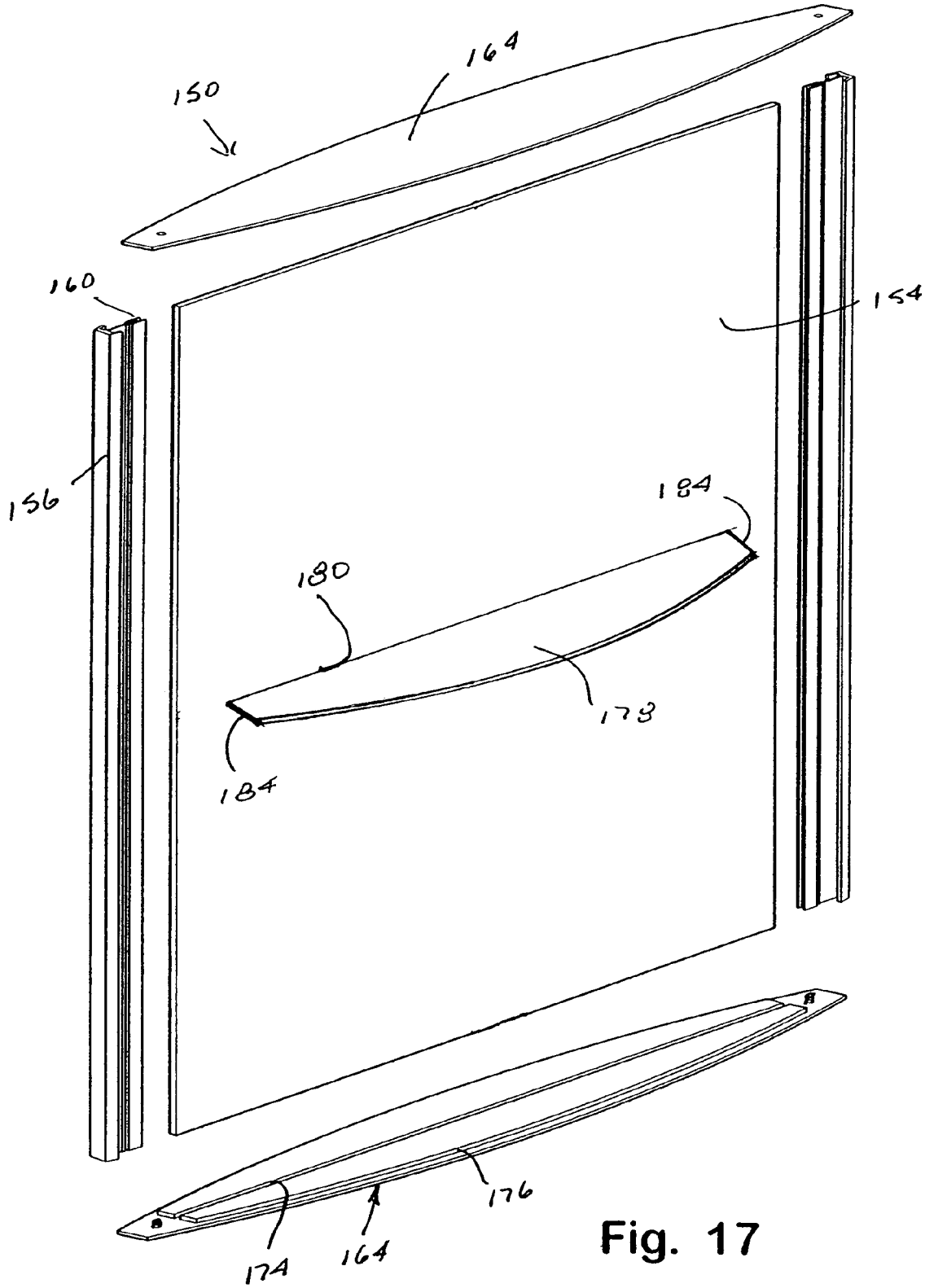
FIG. 17 is an exploded perspective view of the sign frame of the sign of FIG. 15.
Figure 18:
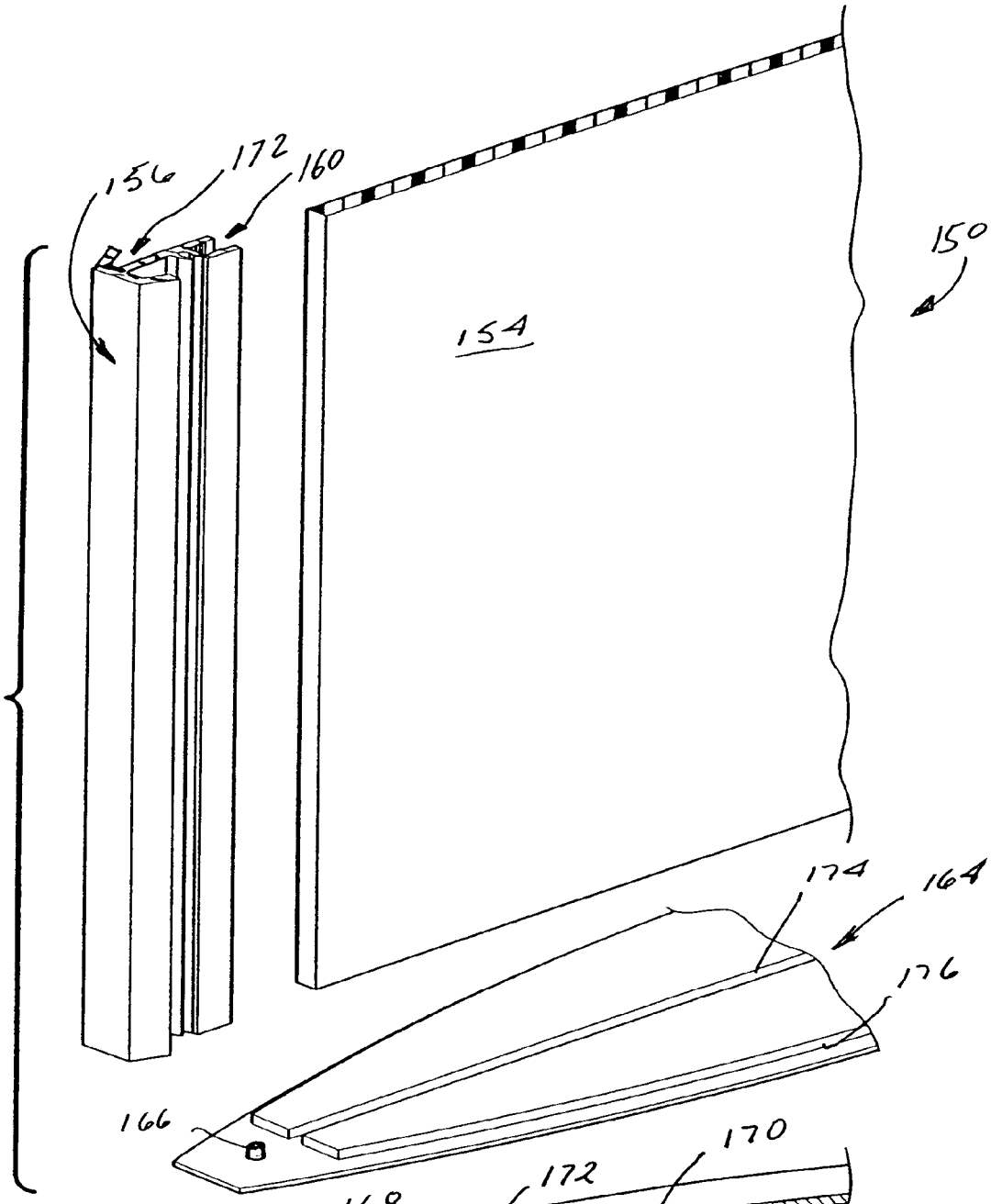
FIG. 18 is an enlarged fragmentary detail view of the lower left corner of the view of FIGS. 17.

As shown in FIG. 14, end rail or channel member 122 includes a vertical opening 136 therethrough. This opening serves to align and sometimes attach upper and lower cover plates 138, which fit on the opposing top and bottom ends of the sign. Cover plates 138 may also be formed of ABS plastic. As shown in FIG. 13, plates 138 are formed of plastic sheet and are machined in a CNC machine to have a recessed forward lip 141 that supports the signage 121 and a transverse groove 140 that receives a lower edge 142 of member 126. Member 126 is solvent welded to plate 138 using MEK solvent or the like for a rigid, permanent bond. A boss 144 adjacent an end of plate 138 fits in opening 136 in end rail 122 and properly locates plate 138 with respect to the end rail.

A fifth embodiment of the present invention 150 is shown in FIGS. 15-19. Sign 150 is a relatively large two-sided sign employing the swedge rail construction of the fourth embodiment described above. In sign 150, curved signage inserts 152 are positioned on opposite sides of a sign frame 154, which constitutes a pair of end rails 156 and an intermediate support member 157 in the form of a plastic sheet or plate extending between the end rails. Again, swedge fittings 160 engage and hold securely the side edges of plate 157.

Figure 19:
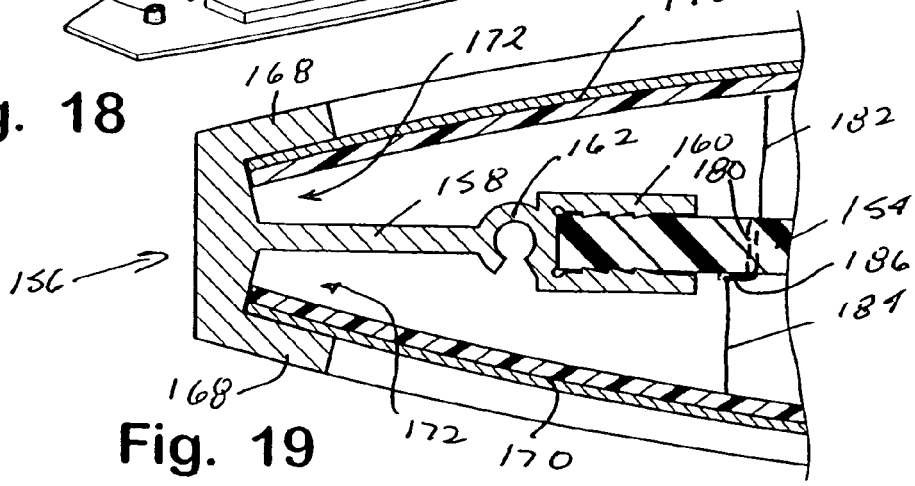
FIG. 19 is an enlarged fragmentary cross-sectional view of the detail 19 of FIG. 16.

The details of end rails 156 are shown in FIG. 19. Each end rail 156 includes a central leg 158 having a swedge fitting 160 on an inner end thereof and having an opening 162 for locating upper and lower cover plates 164 by means of bosses 166. If desired, threaded fasteners, such as eye bolts 167, may be threaded into openings 162 from the upper end of the signs in order to suspend the signs from a ceiling or the like.

Outer ends of end rails 156 include inclined flanges 168 on both sides of central leg 158 so that signage 170 can be contained in an arcuate position on both sides of the sign, with the ends of the signage being retained in slots 172 positioned between flanges 168 and leg 158.

The upper and lower cover plates 164, which are identical, include a central groove 174 formed by CNC Milling. Also, a recessed lip 176 is formed on both sides of the cover plates. The inner lower and upper edges of the signage inserts rest against recessed lips 176 at the top and bottom edges of the sign, so as to hold the inserts in a proper arcuate position in the assembled sign.

The sign of this embodiment is designed for applications that are at least six inches (152 mm) wide, with standardized sizes of 6 inches (152 mm), 8½ inches (216 mm), 11 inches (279 mm), 14 inches (356 mm) or 17 inches (432 mm) being contemplated The width may be extended to over 60 inches (1524 mm) wide, if desired. The height of the sign may be as little as one inch (25 mm) but typically would be at least two inches (50 mm) and may be any height, up to and exceeding 96 inches (2438 mm) high.

When the sign height exceeds 7 to 10 inches (178-254 mm), one or more internal support ribs 178 may be employed. Support ribs desirably are spaced apart by about 4 to 7 inches (102-178 mm) and preferably about 10 inches. Support ribs 178 fit in slots 180 in plate 154. The support ribs desirably are formed with offset ends 182 and 184 on side edges thereof, with offset ends 182 being shifted laterally in one direction with respect to ends 184. With this construction, the rib can be mounted in the slot 180 in plate 154 by inserting one end 184 through the slot and then rotating the support rib until the outwardly extending portions 186 of ends 184 bear against the face of plate 154. The overlapping ends of the support ribs thus cause the support rib to be accurately located with respect to plate 154. The rib is then solvent welded in place as discussed above.

All of the synthetic resin parts are formed from flat sheet stock by means of a CNC machine and thus can be formed very accurately and relatively inexpensively, such that the parts fit tightly together and may be fused rigidly with a solvent welding material such as MEK.

Figure 20:
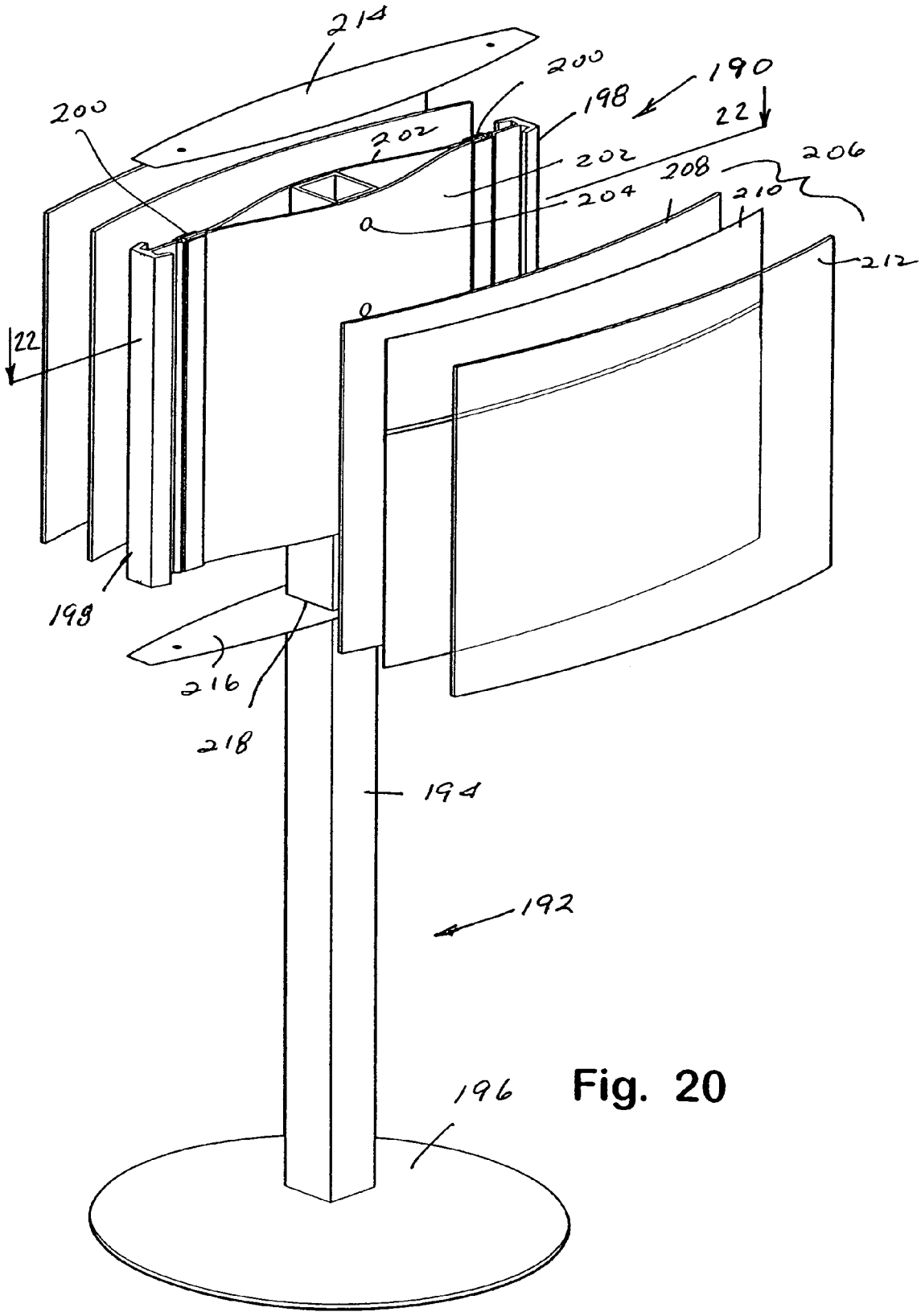
FIG. 20 is an exploded perspective view of a sixth embodiment of a sign constructed in accordance with the present invention, showing a two-sided pole-mounted pedestal sign.
Figure 22:
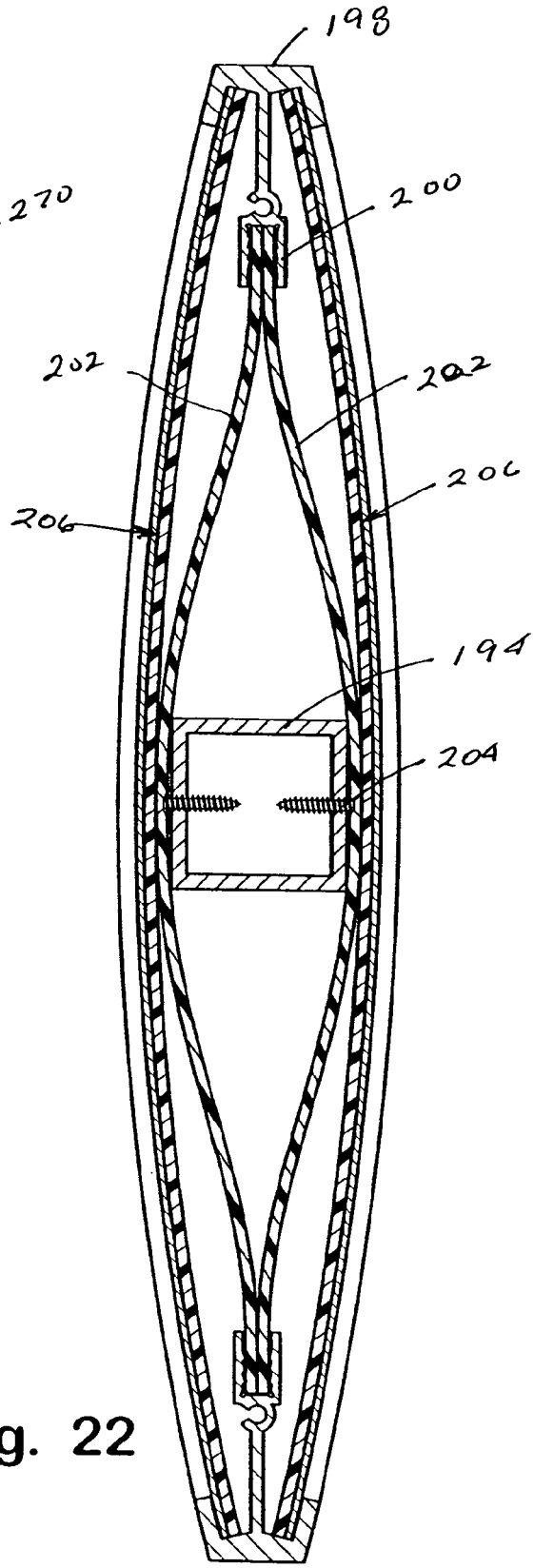
FIG. 22 is an exemplary cross-sectional view along line 22-22 of each of the signs of FIGS. 20 and 21.

A sixth embodiment 190 of the present invention is shown in FIGS. 20 and 22. This embodiment is a two-sided sign mounted on a pedestal base 192 which includes a support post 194 mounted on base 196. Base 196 is shown as a round base, but this base may be any shape, and the base may be attached to the floor if desired.

Sign 190 includes end rails or channel members 198 that are similar to end rails 156 of the previous embodiment. These end rails include swedge fittings 200. The swedge fittings attach to a pair of flexible intermediate plates 202 that are mounted by screws 204 or other fasteners to pole 194 to hold the sign in place on the pole. Signage inserts 206 comprising backer 208, sign member 210 and transparent lens 212 fit in grooves or open-sided channels in end rails 198 in the manner described above. Upper and lower plates 214 and 216 cover the top and bottom ends of the signs respectively. Bottom plate 216 has an opening 218 therein that fits over pole 194. The opposing upper and bottom plates 214 and 216, respectively, may be attached by threaded fasteners or the like.

Figure 21:
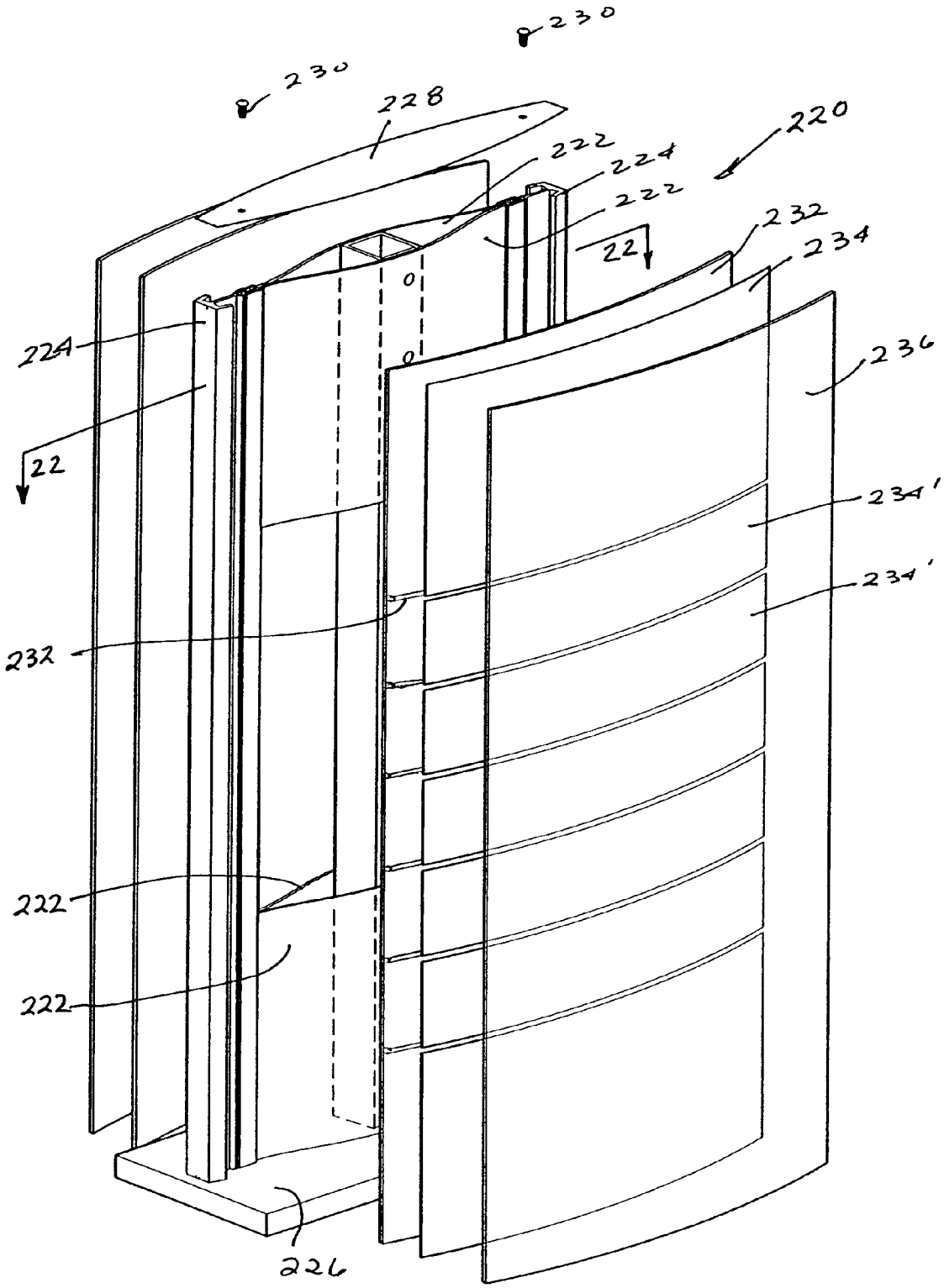
FIG. 21 is a perspective view of a seventh embodiment of a sign constructed in accordance with the present invention, showing a two-sided floor-standing pedestal sign.

A seventh embodiment 220 is shown in FIG. 21. This embodiment is similar to the embodiment 190 of FIG. 20, except that the sign goes all the way to the floor. In this construction, a pair of flexible plates 222, similar to plates 202, are attached on opposite sides of the pole at upper and lower ends thereof, and elongated end rails 224 (which may be the same as extrusions 198) are connected to the side edges of both the upper and the lower plates 222. The lower end of the sign may rest on a base 226. An upper plate 228 may be attached by threaded fasteners 230 to the upper end of the sign by means of openings in the upper ends of the end rails or channel members, of the type represented by opening 162 in FIG. 19.

Signage inserts may include backer 232, signs 234 and, possibly a lens 236. If sign 234 is a full length, single piece sign, a lens would be used. If, however, as shown, separate signs 234 and 234' and the like are used, a lens typically is not used. Instead, accent strips of the type represented by accent strips 92 in FIG. 6, which are attached to the backer by double-sided tape, are employed to separate the signs, and no lens are employed. Typically, the accent strips extend slightly forwardly past the face of the sign, so as to create a raised ridge.

Figure 23:
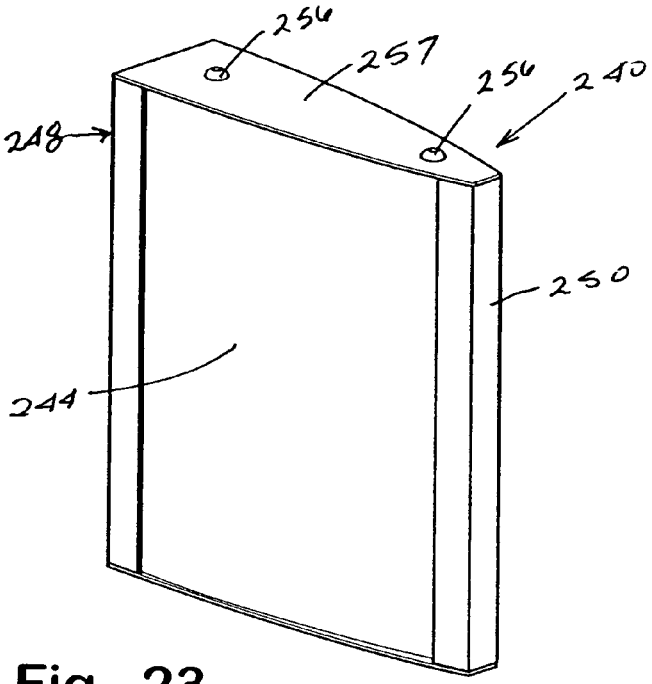
Figure 24:
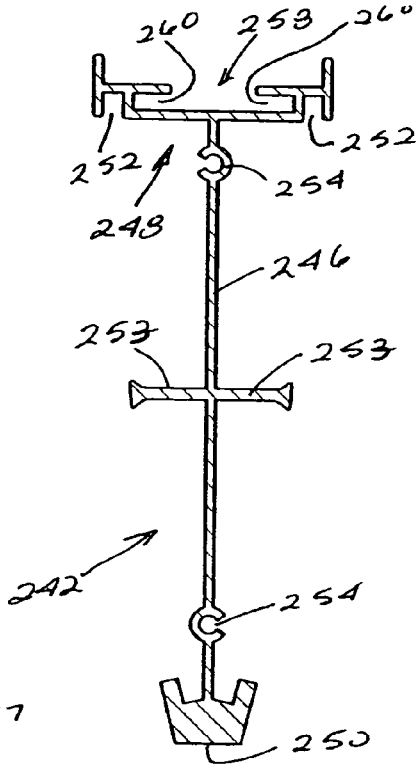
FIG. 24 is a cross-sectional view of an internal support frame thereof, along line 24-24 of FIG. 25.
Figure 25:
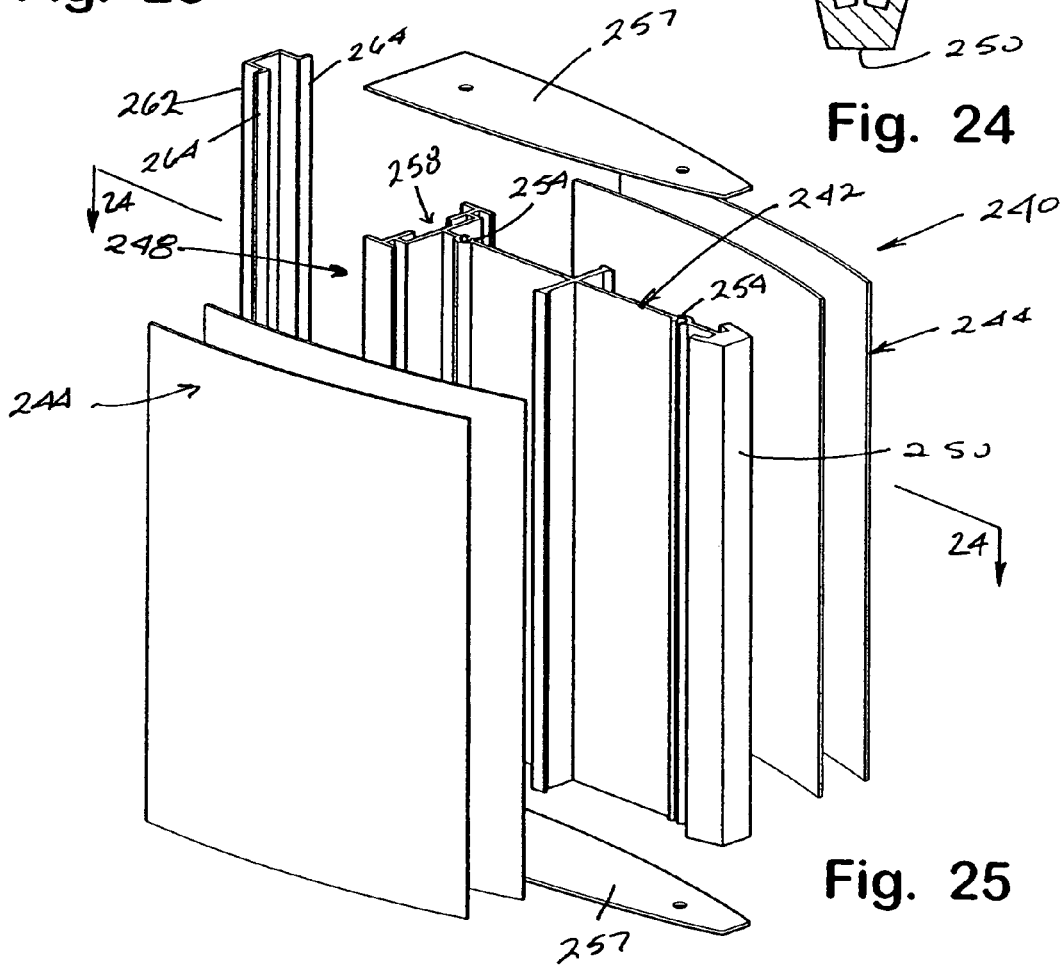
FIG. 25 is an exploded perspective view of the sign of FIG. 23, further showing a channel flange mounting bracket.

An eighth embodiment 240 is shown in FIGS. 23-25. This embodiment represents a perpendicular sign, designed to be attached on an edge to a ceiling or wall and extend perpendicularly therefrom. Sign 240 includes a central frame member 242 with curved or arcuate sign elements 244 on opposite sides of the frame. Typically it is formed as an extrusion and includes a central support plate 246 that extends outwardly from a relatively wide base at one edge or a rear of the sign to an end rail or open-sided channel 250, at an opposing, outer edge of the frame. End rail or channel member 250 is formed in a manner similar to the end rails in prior embodiments. Base 248 is wider than the end rail 250, but includes grooves or open-sided channels 252 adjacent side edges of the base for receipt of side edges of signage 244. Transverse ribs 253 extend outwardly from central support member 246 an d provide intermediate support for sign elements 244. Openings 254 at inner and outer ends of the central support member may receive threaded fasteners 256 for mounting end plates 257 over opposing ends of the sign. Base 248 may include a slot 258 for a cooperating channel shaped support bracket 262, with transverse slots 260 being adapted to receive outwardly extending flanges 264 on the bracket.

A channel shape mounting member 262 is mounted with the back of the channel against the mounting surface and with legs of the channel extending outwardly therefrom. Lateral flanges 264 extend outwardly from outer ends of the legs, and these flanges fit in slots 260 in the backside of the base 248 of central frame member 242. The frame is fitted on the mounting member 262 with either the top or bottom plate and then the plate is screwed in place, locking sign on the bracket.

The foregoing sign is designed for somewhat smaller installations, with the sign being about four inches (102 mm) between the base and the end rail and being from 1 to 96 inches (25.4-2438 mm) or more high, between the end plates 257.

Figure 28:
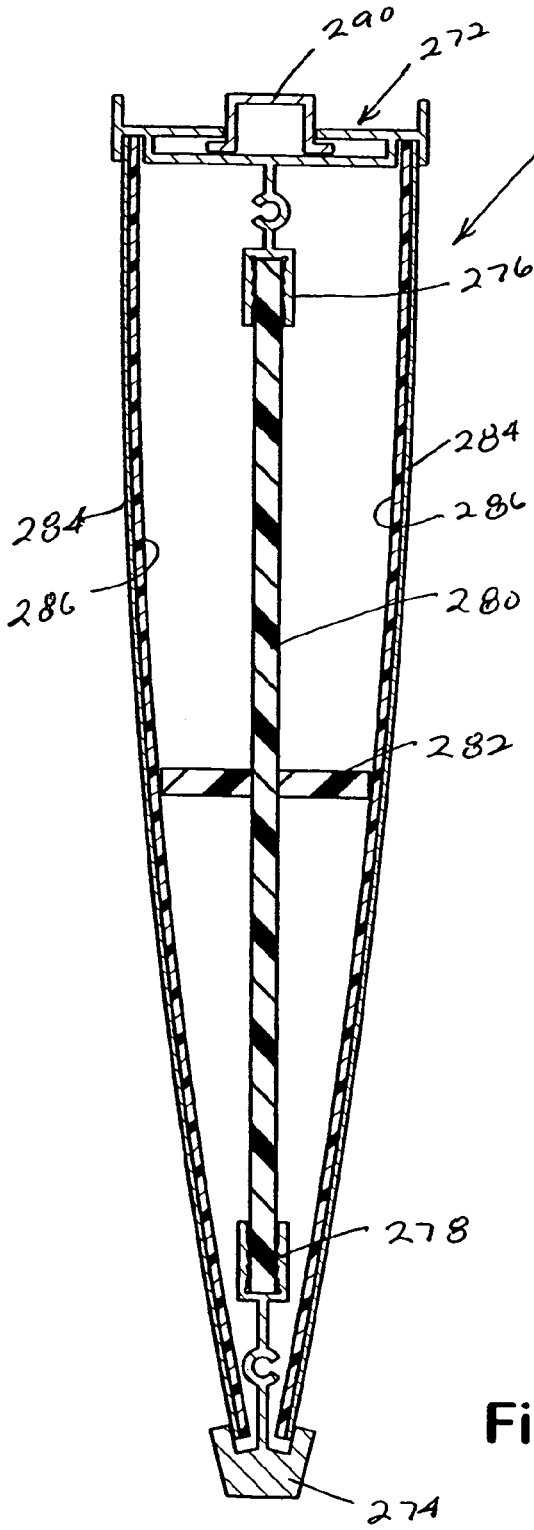
FIG. 28 is a cross-sectional view along line 28-28 of FIG. 27.
Figure 26:
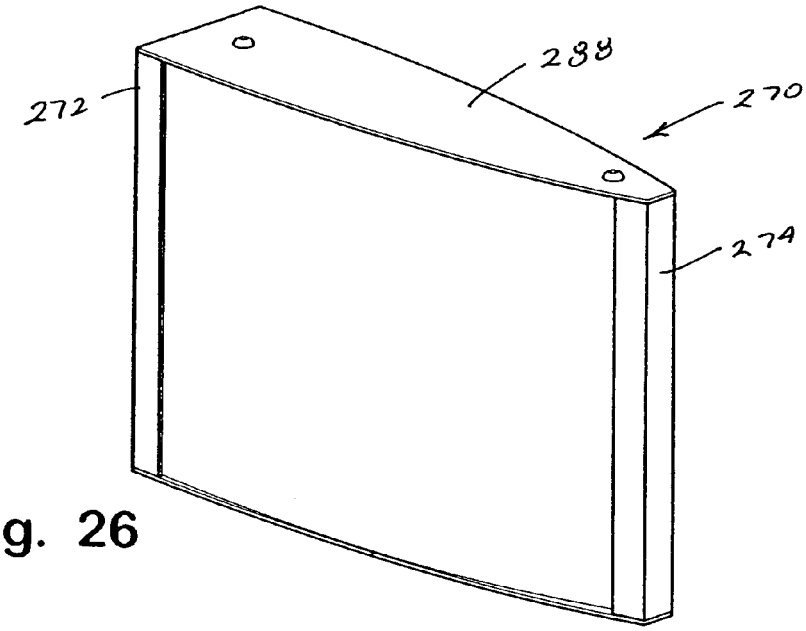
Figure 27:
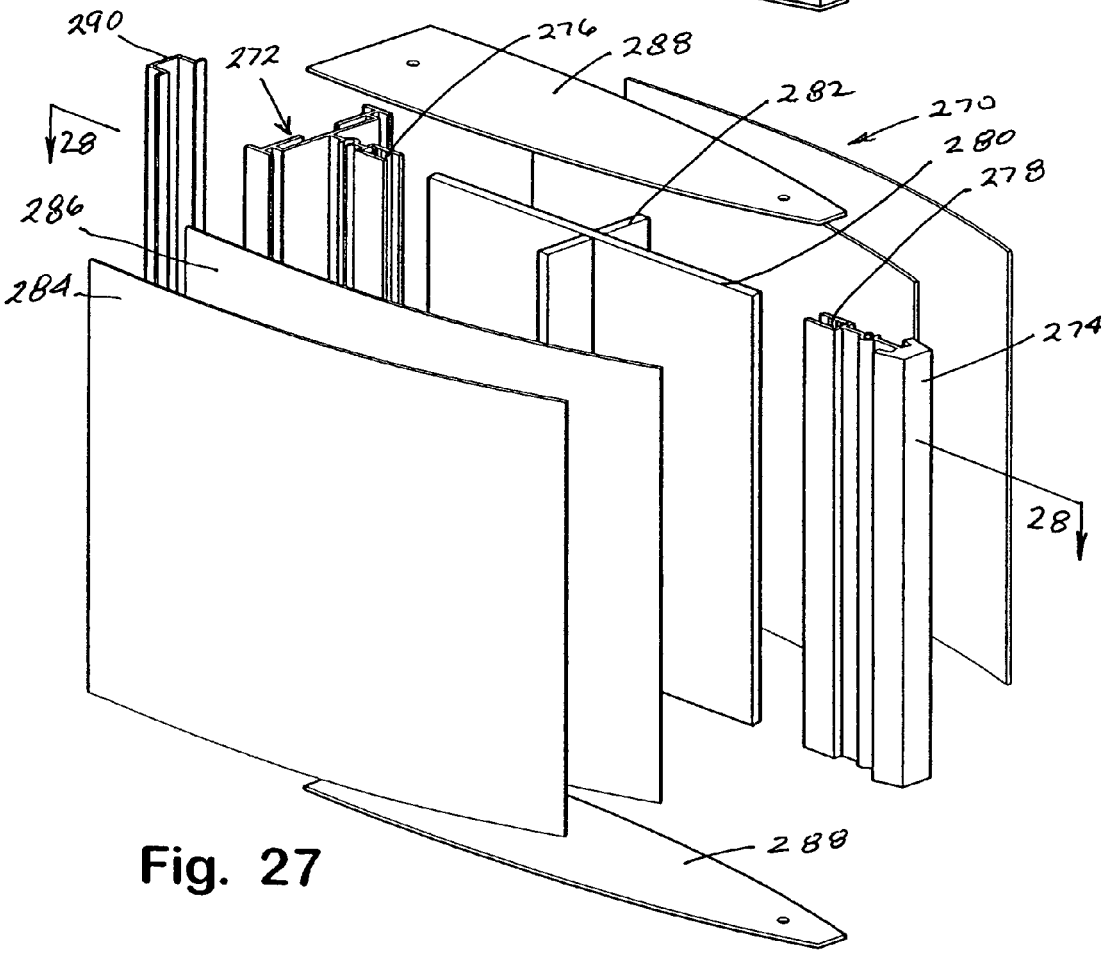
FIG. 27 is an exploded perspective view of the sign of FIG. 26, showing a channel flange mounting bracket for mounting the sign on a wall.

A ninth embodiment of the present invention 270 is shown in FIGS. 26-28. This is a perpendicular mount sign as in the previous embodiment, but it is designed for somewhat larger installations, with the width of the sign, between the opposing channel members 272 and 274, typically being 8½, 11, 14 or 17 inches (216 279, 356, or 432 mm, respectively) or larger and with the length of the sign, between the opposing end plates 288, being unlimited. The sign construction is similar but instead of the single extruded central frame member 242 of the prior embodiment, this embodiment uses a separate base member 272 and end rail 274, with the base and end rail having swedge fittings 276 and 278, respectively. An intermediate plastic plate 280 extends between the base and end rail and is attached thereto by means of the swedge fittings. An intermediate reinforcement or support rib 282 attached as described in previous embodiments may be used to reinforce the side of sign elements 284 and 286 on each side of the sign. Upper and lower plates 288 cover the upper and lower ends of the sign. The sign is attached to a channel flange mounting bracket 290 of the type described above.

Because this sign employs an intermediate plate 280, which may be varied in width, the width of this sign may easily be varied to provide signs having a width of 8½, 11, 14 and 17 inches (216 279, 356, or 432 mm, respectively), or larger. Again, standard sizes that accommodate paper signs of readily available dimensions make it possible to prepare signs using a computer and ordinary copy paper.

Figure 31:
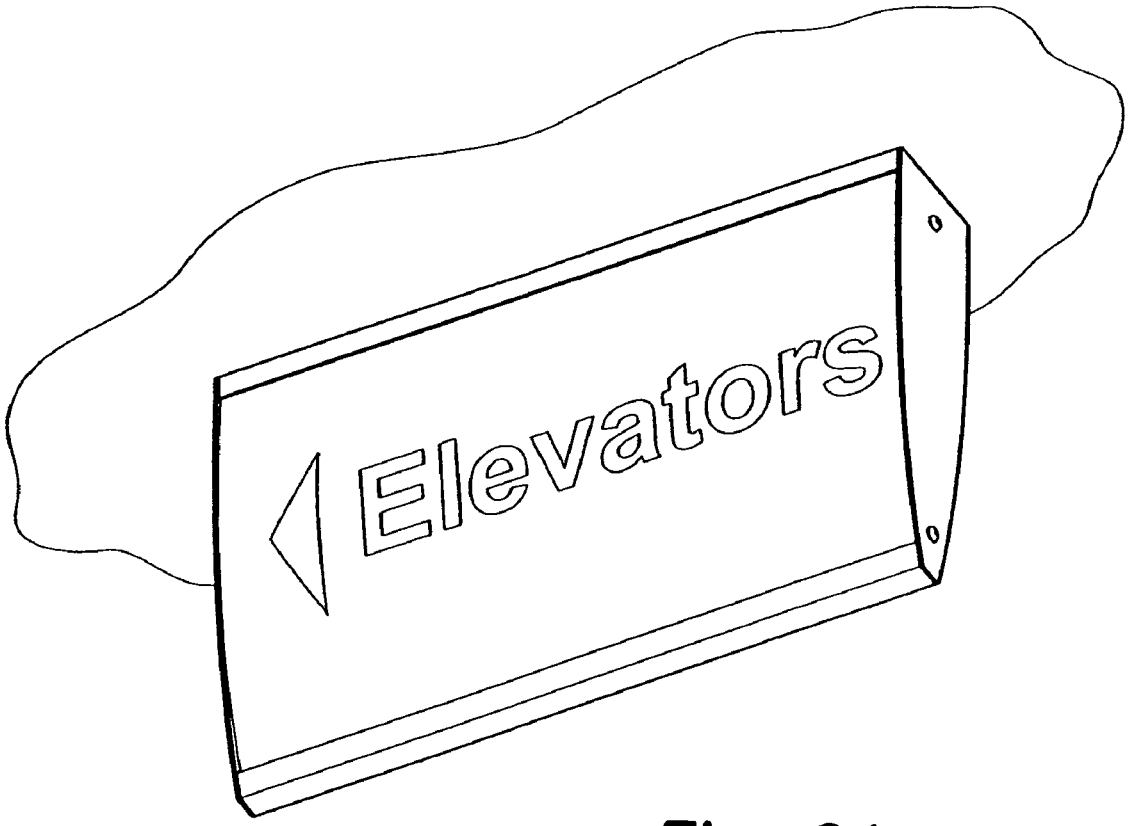
FIG. 31 is a perspective view of a ceiling-mounted sign of the construction shown in either FIGS. 23 or 26.

An example of an installation wherein the signs of FIGS. 23 or 26 are mounted on a ceiling is shown in FIG. 31.

Figure 29:
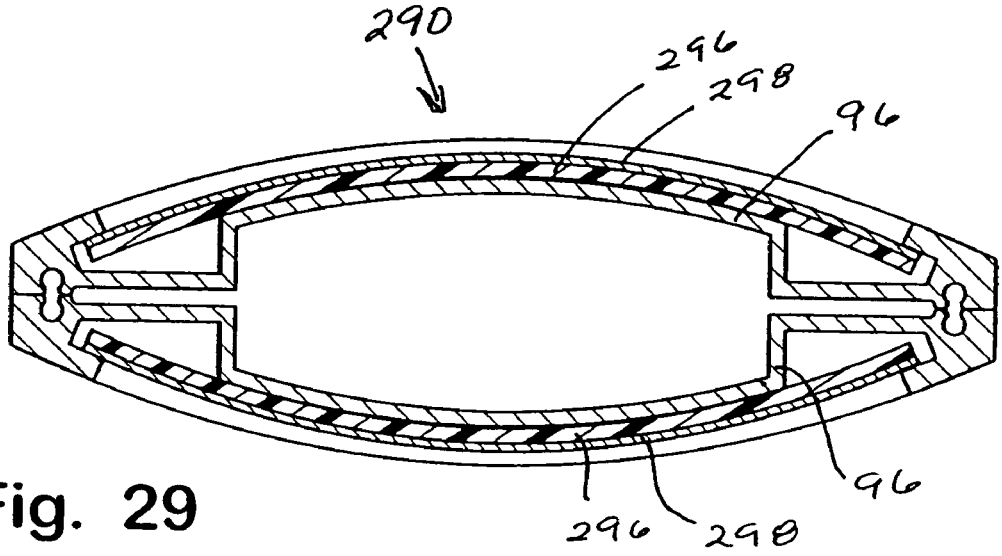
FIG. 29 is a cross-sectional view of a tenth embodiment of a sign constructed in accordance with the present invention, showing a two-sided sign assembled by back-to-back orientation of two of the signs of the third embodiment of FIGS. 7-9.
Figure 30:
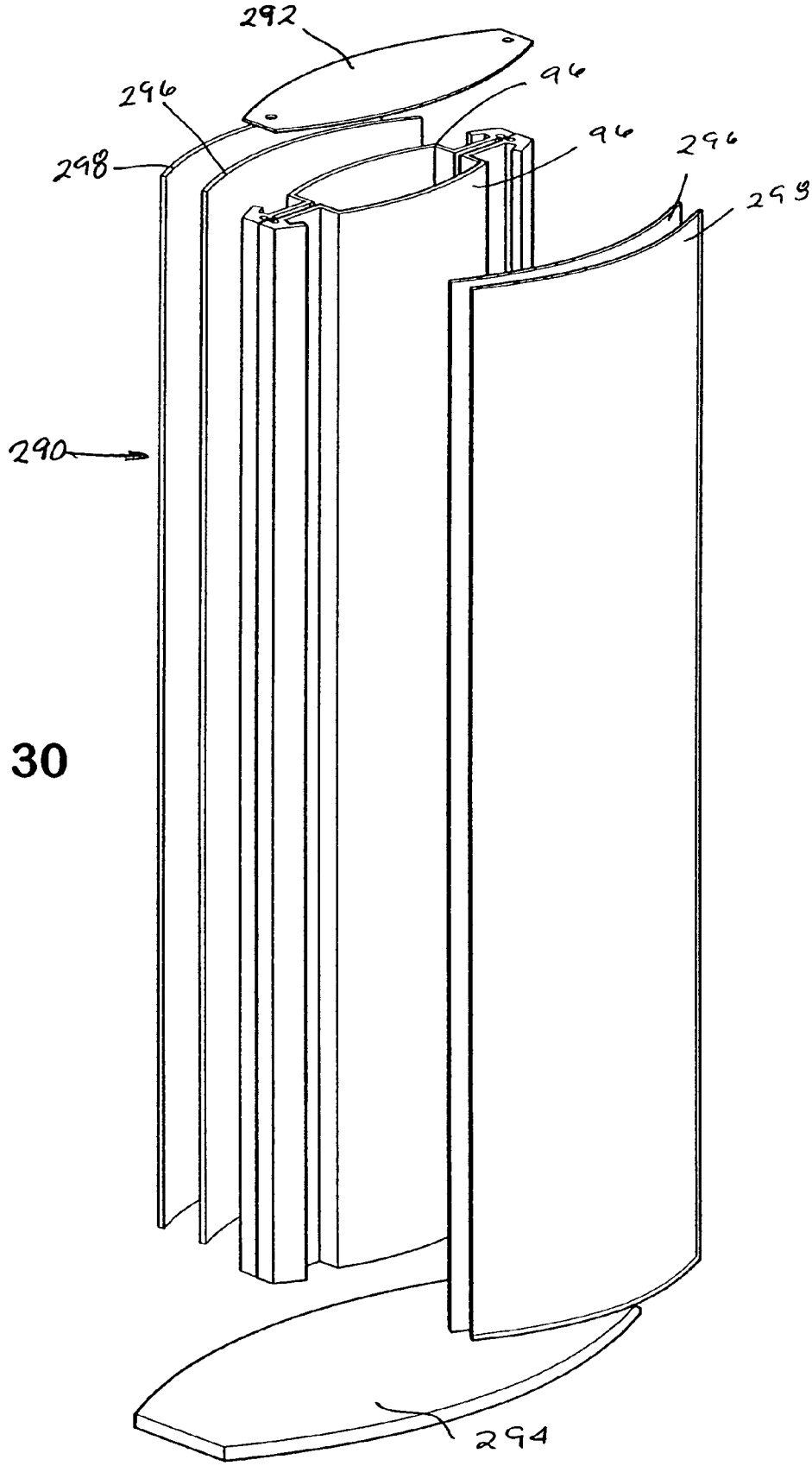
FIG. 30 is an exploded perspective view of a floor-mounted sign employing the two-sided sign frame of FIG. 29.

A tenth embodiment 290 of the present invention is shown in FIG. 30 and 29. In this embodiment, two of the extruded sign frames 96 of the type shown in FIG. 9 are attached back to back and mounted on a base 294 and covered by a top plate 292, making a relatively thin (generally about 4 inches, 102 mm) pedestal sign. The signage elements 296 and 298 may be the same as used for other embodiments described above.

Figure 32:
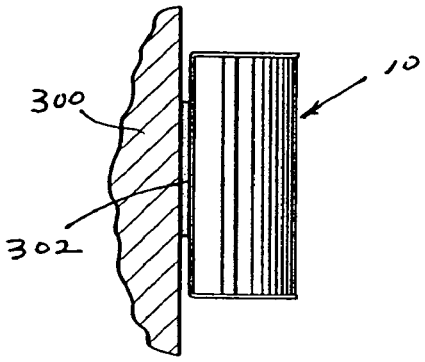
FIG. 32 is a side elevation view of the sign of FIG. 1 mounted on a wall by means of pressure-sensitive tape.
Figure 33:
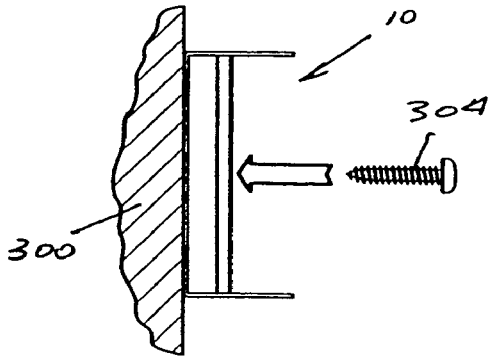
FIG. 33 is a side elevation view of a sign frame of the sign of FIG. 1 showing the frame being mounted on a wall by means of threaded fasteners.
Figure 37:
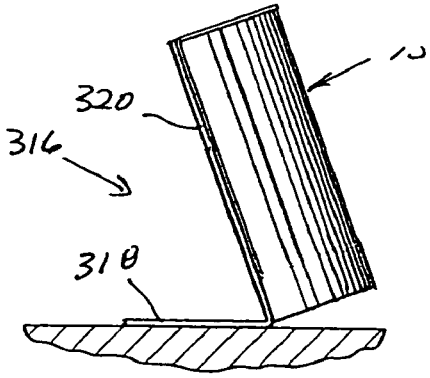
FIG. 37 is a side elevation view of the sign of FIG. 1 mounted on a free-standing support whereby the sign is supported on a horizontal surface.

FIGS. 32 and 37 show exemplary ways in which one sided signs constructed in accordance with the present invention may be mounted. Using sign 10 as an example, this sign is mounted on a wall 300 in FIG. 32 by means of double-sided tape 302. Same sign is screwed to wall 300 by means of threaded fasteners 304 in FIG. 33, with the signage elements being removed so that the back of the sign is accessible for screwing the sign to the wall.

Figure 34:
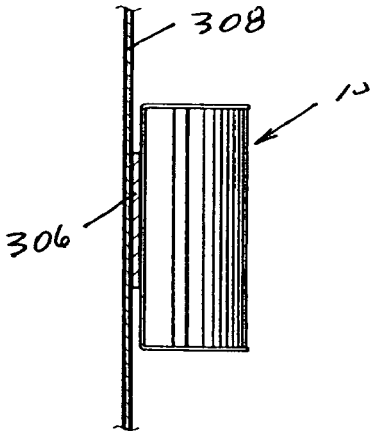
FIG. 34 is a side elevation view of the sign of FIG. 1 mounted on a wall by means of a magnetic mounting.

A magnetic attachment such as magnetic tape 306 is used in FIG. 34 for attaching sign 10 to a steel wall 308.

Figure 35:
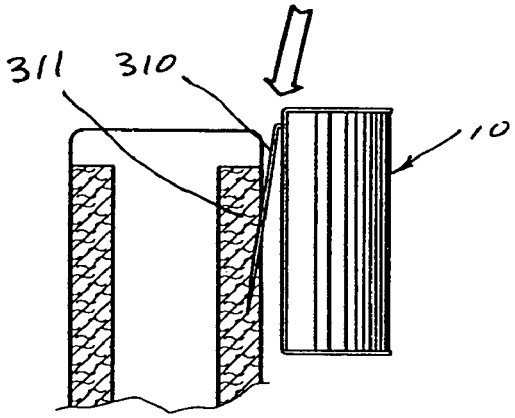
FIG. 35 is a side elevation view of the sign of FIG. 1, showing the sign being mounted on a fabric surface by means of a pin.

A pin 310 affixed to the back of sign 10 is used to attach the sign to a fabric panel or wall 311 in FIG. 35.

Figure 36:
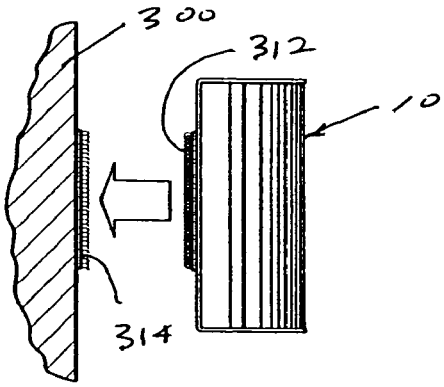
FIG. 36 is a side elevation view of the sign of FIG. 1, showing the sign being mounted on a wall by means of a hook and loop fastener system.

A hook and loop fastener comprising a hook section 312 and a loop section 314 attached to wall 300 and to sign 10 (with a hook or loop section being attached to either element) is used to mount the sign in FIG. 36.

An angle bracket stand 316 comprising base 318 and back support 320 is used to support the sign 10 on a desktop or the like in FIG. 37.

Figure 38:
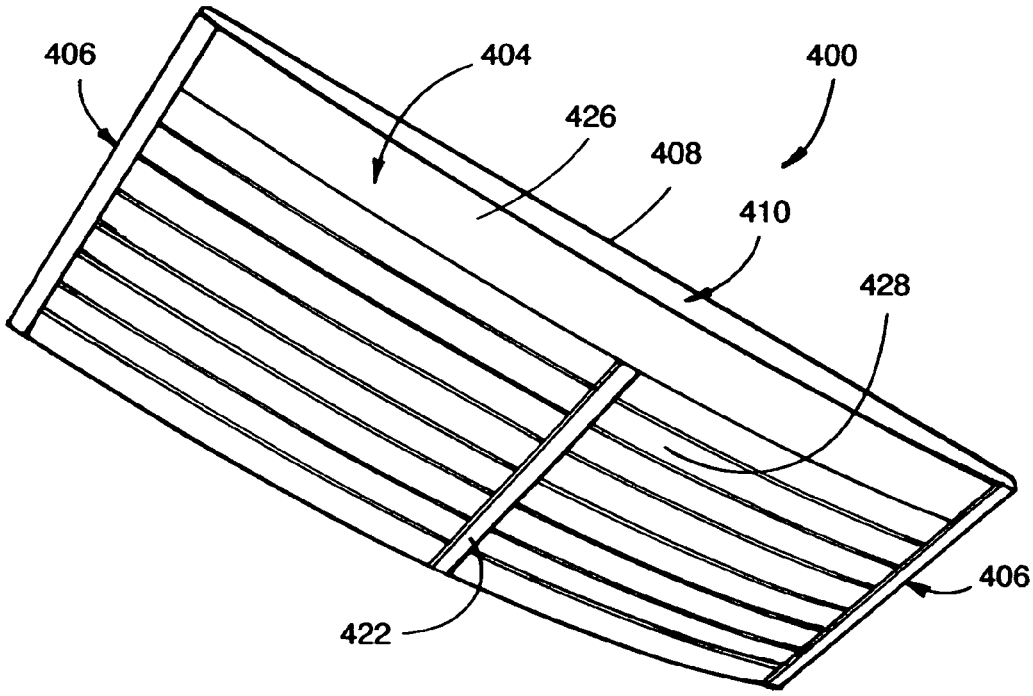
FIG. 38 is a top front perspective view of an eleventh embodiment of a sign according to the invention.
Figure 39:
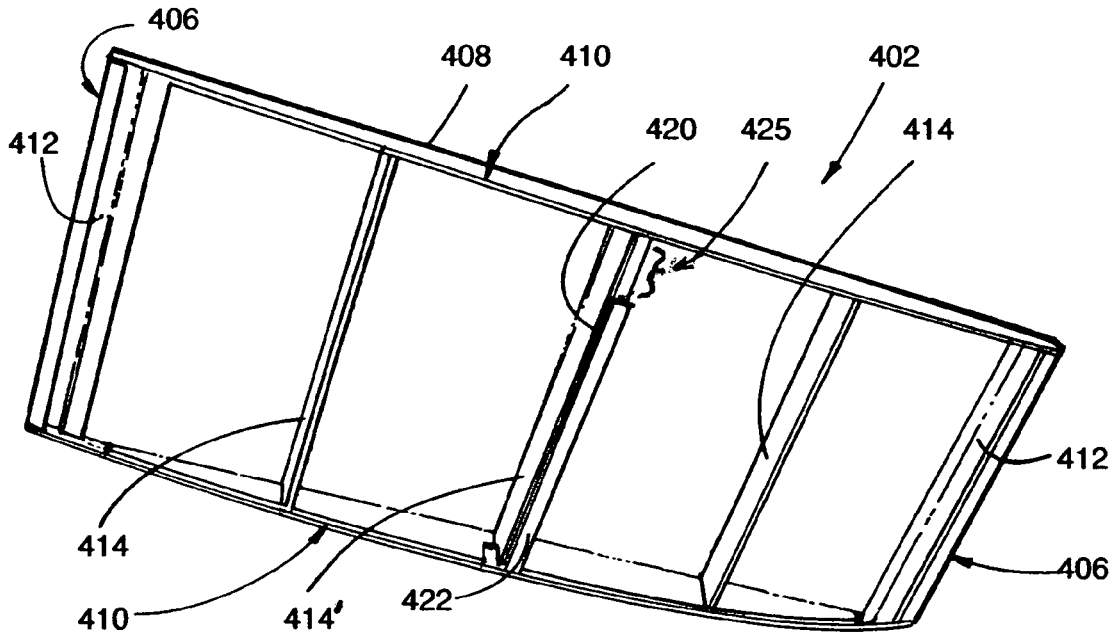
FIG. 39 is the view of FIG. 38 with the sign panels removed, showing a sub-assembly thereof.
Figure 40:
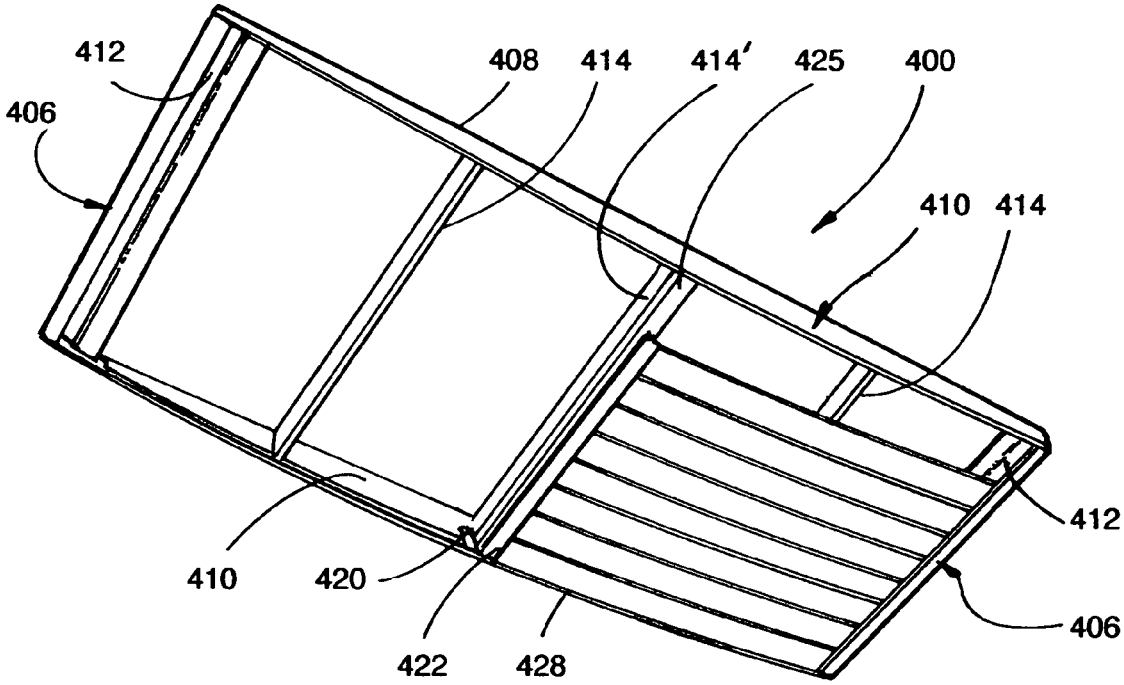
FIG. 40 is the view of FIG. 39 with a sign panel portion installed.
Figure 41:
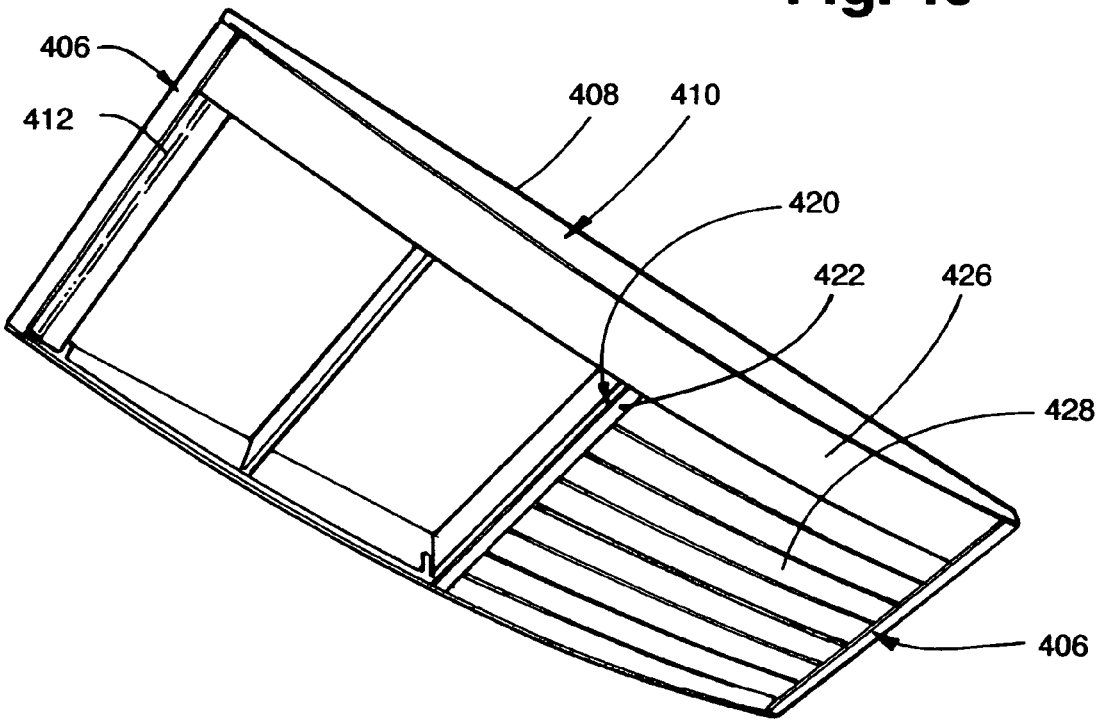
FIG. 41 is the view of FIG. 40 with another sign panel portion installed.

Another exemplary configuration of a curved sign assembly according to the invention is shown in an eleventh embodiment 400 (FIGS. 38-40). As with the embodiments discussed above, the present embodiment of a curved sign assembly 400 includes at least a frame sub-assembly 402 and a sign panel 404. Various components of the sign assembly 400 are the same as discussed above, being that they all are part of a modular sign assembly system of the invention. Thus, further detailed discussion of common elements with prior embodiments may in large part be omitted as being redundant.

The frame 402 has opposing side edges 406 and opposing top and bottom edges 408. Top and bottom end plates 410 extend in a common direction from their respective top and bottom edges. Open-sided channels or channel members 412 that define open-sided channels extend along the opposing side edges of the frame assembly and may be provided by edge rails as discussed above.

While an intermediate support has generally been provided in the embodiments discussed above by way of an arcuate plate, at least one intermediate support 414 in the form of a rectangular plate may be provided in the curved sign assembly 400. Each intermediate support has a length that extends between the opposing top and bottom edges 408 of the frame assembly. It is noted that the prior embodiments above show the arcuate plate or support having a length that may extend between opposing side edges.

Figure 42:
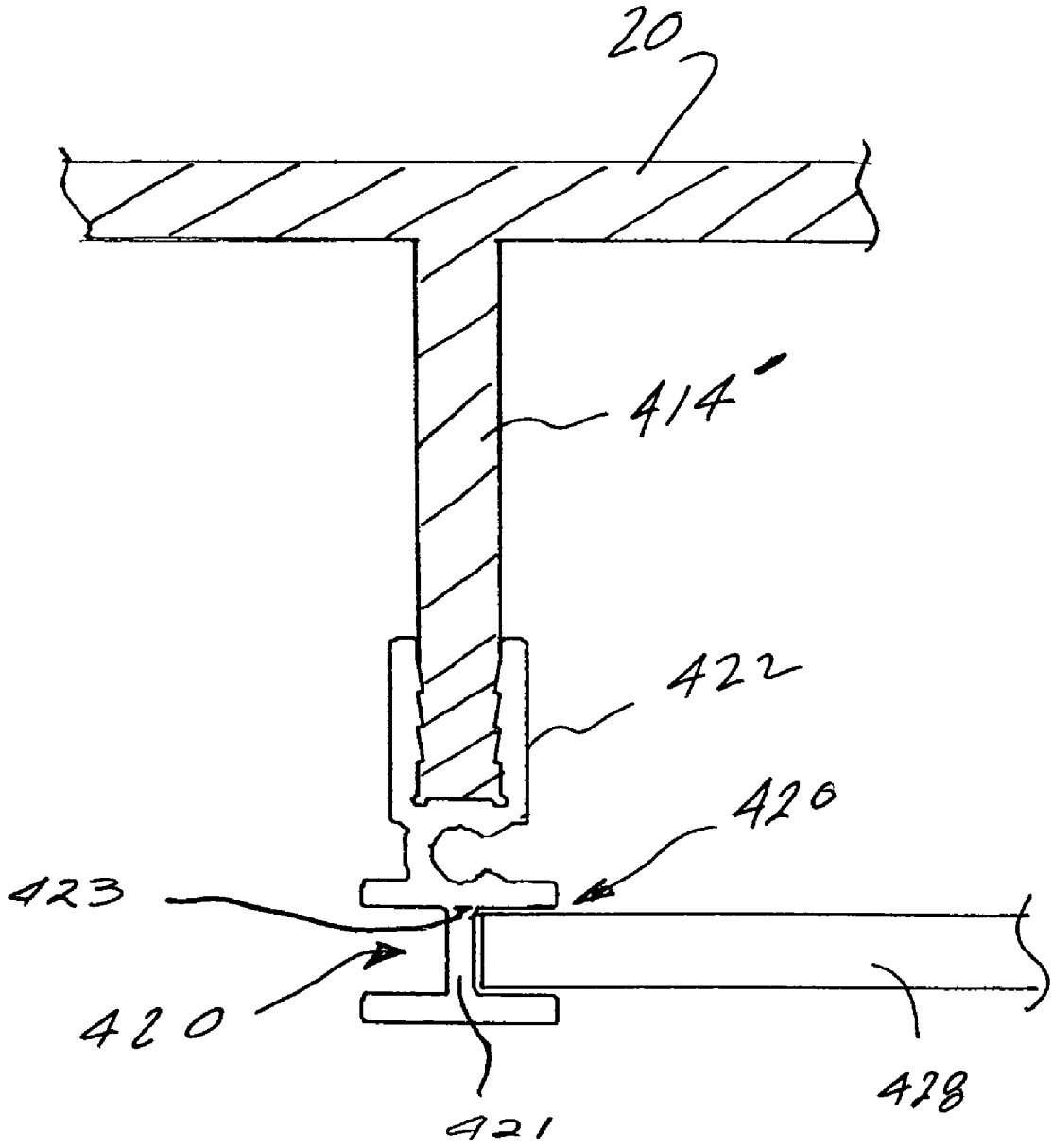
FIG. 42 is a fragmentary enlarged detail along line 40-40 of FIG. 39.

Each intermediate support 414 extends in a direction from a sign back to a sign front, from a base edge to a terminal edge. At least one open-sided channel 420, and more preferably a pair of opposing open-sided channels 420 are provided along the terminal edge of at least one of the intermediate support members 414', which positions the open-sided channel in the plane of the curved sign on a front or display side of the sign assembly. The open-sided channel or channels 420 may be defined by a swedge member 422 that is releasably pressed onto the support terminal end in force fit engagement, as discussed above in greater detail regarding swedge fittings 124 (FIG. 14) and 160 (FIG. 19), for example, and others. The swedge member may optionally extend partially or fully along the support member terminal edge. As shown in FIGS. 38 and 39, the swedge extends along the full length of a support member 414', but the outer portion 421 of the channel is removed from swedge 422 at phantom line 42B (FIG. 42) in order to provide a partially relieved or cut away portion 425 that supports a full length sign panel 426 that extends all the way between the edges of the frame (FIGS. 38-41). Further, one of the two opposing open-sided channels faces one of the opposing side edges of the sign assembly, while the other open-sided channel faces the other opposing edge of the sign assembly.

With the swedge member 422 extending partially along the support member terminal edge or with the outer portion of the channel being partially cut away, as discussed above, the curved sign assembly 400 allows a user to have a sign segment 426 extend fully across the subframe assembly from an open-sided channel 412 at one of the two opposing side edges 406, across the intermediate supports 414, to the opposing open-sided channel at the other opposing side edge. Alternatively, a sign portion 428 may extend partially across the sign from one of the opposing side edges to an open-sided channel 420 at one of the intermediate supports. Thus, this embodiment 400 of the modular curved sign assembly system of the invention provides further sign display configurations.

A principal advantage of the present invention is that with a small number of components, a wide variety of signs may be constructed of various widths and various lengths, with the signage inserts being easily mounted and removable from the sign support frames. The stamped metal frames are desirably formed of stamped sheet metal such as steel. The extruded members are desirably formed from aluminum or an aluminum alloy. Alternatively, any of the sign frames may be finished with a painted surface or covered with a laminate or wood veneer or paneling in order to provide any desired type of exterior appearance.

It should be understood that the foregoing is merely exemplary of the preferred practice of the present invention and that various changes and modifications may be made in the details and arrangements of the construction of the embodiments disclosed herein without departing from the spirit and scope of the present invention. For example, the materials and fabrication methods discussed are beneficial to the inventor, while others who practice the invention may prefer other materials and fabrication methods.

The invention claimed is:

1. A curved sign assembly, comprising:

a frame having opposing first and second frame edges, having opposing third and fourth frame edges, and having opposing first and second frame sides, the first frame side facing a first direction and the second frame side facing an opposing second direction;

a first plate extending toward the first direction from the first frame edge to a first plate terminal edge;

a second plate extending toward the first direction from the second frame edge to a second plate terminal edge;

a first channel member extending along the third frame edge and between the opposing first and second frame edges, the first channel member defining a first open-sided channel with the open side opening on the first frame side and toward the fourth frame edge;

a second channel member extending along the fourth frame edge and between the opposing first and second frame edges, the second channel member defining a second open-sided channel with the open side opening on the first frame side toward the third frame edge;

a substantially rigid intermediate support that has a support length, has a support base edge extending along the support length, and has an opposing support terminal edge extending along the support length, the support length extends between one of the opposing first and second frame edges and the opposing third and fourth frame edges, the intermediate support also extends in the first direction from the support base edge to the support terminal edge;

a sign panel having opposing first and second sign edges and having opposing sign back and sign display surfaces that extend between the first and second sign edges, the first sign edge being seated in the first open-sided channel in releasable engagement, the sign panel extending from the first open-sided channel and across the intermediate support to the second open-sided channel, the second sign edge being seated in the second open-sided channel in releasable engagement, the sign back surface engaging the intermediate support, the sign panel being curved between the first and the second open-sided channels, the intermediate support being shaped and positioned so as to support the sign panel in its curved position between the first and second open-sided channels.

2. The assembly of claim 1 in which at least one of the first plate terminal edge and the second plate terminal edge is curved and corresponds to an arc of the curved sign panel.

3. The assembly of claim 1 in which at least one of the pair of the first and the second plates and the pair of the first and the second channel members is parallel.

4. The assembly of claim 1 in which the intermediate support is oriented either with the support length extending between the first and the second open-sided channels with the support terminal edge having a fixed curved shape corresponding to an arc of the curved sign panel, or with the support length extending between the opposing first and second frame edges and the support terminal edge having a fixed straight edge that extends into contact with a side of the sign panel parallel to its axis.

5. The assembly of claim 1 in which the intermediate support assembly comprises at least two intermediate supports.

6. The assembly of claim 1 in which at least one of the first and second channel members is a separate component that is coupled with the corresponding one of the third and the fourth frame edges, the corresponding one of the third and the fourth frame edges having a manually actuatable clamp that securely clamps the one of the first and second channel members with the corresponding one of the third and the fourth frame edges.

7. The assembly of claim 6 in which the corresponding one of the third and the fourth frame edges has a flange and the one of the first and second channel members has a cooperating flange groove in which the flange is received in slip fit engagement.

8. The assembly of claim 1 in which at least one of the first and second channel members is a separate component that is releasably coupled with the corresponding one of the third and the fourth frame edges, whereby the curved sign assembly is reconfigurable.

9. A curved sign assembly comprising:

a frame including:

a pair of generally straight, spaced parallel edge members on opposite sides of an open interior, each edge member including a longitudinal groove that faces the other edge member, each edge member having an inclined flange facing outwardly from a front of the sign adjacent the groove so as to direct an inclined edge of a curved sign panel into the groove; and at least one back member extending between and connecting the edge members so as to hold the edge members in a fixed, spaced relationship with respect to each other;

a flexible, resilient sign panel having front and back sides, the front side being viewable, the sign panel being generally planar when in an undeflected shape but being resiliently deflectable into an arcuate shape by bending the sign panel, the sign panel having parallel side edges at opposite sides of the sign panel, the side edges fitting into the edge member grooves when in an arcuately deflected position, the edge members thereby holding the sign panel in an arcuately deflected position; and a substantially rigid intermediate support for the back of the sign panel, the intermediate support being part of or connected to the frame and extending forwardly from the back member so as to abut and provide support for the sign panel intermediate the edges thereof when the sign panel is mounted in its arcuate position between the edge members, the intermediate support supporting the back of the sign panel so as to urge the sign panel to remain in its arcuate position.

* * * * *